US011072971B1

(12) United States Patent
Header et al.

(10) Patent No.: US 11,072,971 B1
(45) Date of Patent: Jul. 27, 2021

(54) MODULAR SYSTEM FOR GLAZING AND OTHER INFILL PANELS

(71) Applicant: Solar Innovations, Inc., Pine Grove, PA (US)

(72) Inventors: Gregory A Header, Richland, PA (US); Ari Figueroa, Middleton, PA (US); Keith Erdman, Myerstown, PA (US)

(73) Assignee: Solar Innovations, Inc., Pine Grove, PA (US)

( * ) Notice: Subject to any disclaimer, the term of this patent is extended or adjusted under 35 U.S.C. 154(b) by 0 days.

(21) Appl. No.: 15/929,208

(22) Filed: Jan. 24, 2020

(51) Int. Cl.
*E06B 3/58* (2006.01)
*E04B 2/90* (2006.01)
(Continued)

(52) U.S. Cl.
CPC ..... *E06B 3/58* (2013.01); *E04B 2/90* (2013.01); *E04B 1/40* (2013.01); *E04B 1/49* (2013.01); *E04B 2001/3276* (2013.01)

(58) Field of Classification Search
CPC ..... E06B 3/58; E04B 2/90; E04B 2001/3276; E04B 1/40; E04B 1/49
USPC ..... 52/80.1, 80.2, 81.1, 81.2, 81.3, 81.4, 52/81.5, 86, 235, 236.2, 245, 246, 247, 52/248, 249
See application file for complete search history.

(56) References Cited

U.S. PATENT DOCUMENTS 1,261,454 A * 4/1918 Stafford ..... E04B 1/3205 52/245
1,452,583 A * 4/1923 Williams ..... F27D 1/02 52/575
(Continued)

FOREIGN PATENT DOCUMENTS

CA 2638123 A1 1/2009
CN 103015594 B 2/2015
(Continued)

OTHER PUBLICATIONS

Curved Curtain Wall, Jun. 20, 2019, downloaded from the Internet from: http://unleashing.me/curved-curtain-wall/ on Dec. 5, 2019.
(Continued)

*Primary Examiner* — Basil S Katcheves
*Assistant Examiner* — Omar F Hijaz
(74) *Attorney, Agent, or Firm* — Stone Creek Services LLC; Ian M Flum

(57) ABSTRACT

A modular infill panel system for attaching to vertical structural members of a building frame and adjacent modular infill panel units. The modular infill panel system is capable of creating piecewise curves in the vertical plane as well as complex piecewise three-dimensional curves in a combination of horizontal and vertical planes. The modular infill panel system can include vertically stacked modular infill panel units. The modular infill panel units can be vertically aligned and attached to the building's structural columns by bracket assemblies mounted along one or more outside edges of the top frame member of the structural frame of the modular infill panel units. The bracket assemblies can secure the modular infill panel unit to the vertical structure of the building and alignment pins projecting upward from the bracket assemblies can align vertically adjacent modular infill panel units.

18 Claims, 31 Drawing Sheets

(51) Int. Cl.

| | |
|---|---|
| ***E04B 1/49*** | (2006.01) |
| ***E04B 1/41*** | (2006.01) |
| ***E04B 1/32*** | (2006.01) |

(56) References Cited

U.S. PATENT DOCUMENTS

| | | | | | |
|---|---|---|---|---|---|
| 2,077,137 | A * | 4/1937 | Wilkoff | E21D 11/15 | 405/151 |
| 3,742,667 | A | 7/1973 | Tofani, Jr. | | |
| 3,888,055 | A * | 6/1975 | Gallo | E04H 13/006 | 52/98 |
| 3,893,269 | A * | 7/1975 | Nelsson | E04B 1/6108 | 52/65 |
| 3,994,107 | A * | 11/1976 | Aughuet | E04B 2/90 | 52/235 |
| 4,107,887 | A * | 8/1978 | Wendt | E04B 1/86 | 52/105 |
| 4,422,267 | A * | 12/1983 | Whitehouse | E04B 1/3211 | 52/81.1 |
| 4,561,228 | A | 12/1985 | Kaminaga | | |
| 4,563,849 | A | 1/1986 | Mangal | | |
| 4,571,905 | A | 2/1986 | Kaminaga | | |
| 4,942,709 | A * | 7/1990 | Waldron | E04B 2/7425 | 52/285.1 |
| 5,067,295 | A * | 11/1991 | Francik | E04C 1/42 | 52/306 |
| 5,067,300 | A | 11/1991 | Takeda | | |
| 5,740,646 | A * | 4/1998 | Wirkus | E04C 1/42 | 52/306 |
| 6,308,490 | B1 * | 10/2001 | Saebi | E04B 1/32 | 52/200 |
| 6,922,961 | B2 * | 8/2005 | Wright | E04C 1/42 | 446/111 |
| 7,373,763 | B2 * | 5/2008 | Voegele, Jr. | E04C 1/42 | 52/223.7 |
| 7,854,099 | B2 * | 12/2010 | Kidd | E04F 13/083 | 52/489.1 |
| 8,826,620 | B2 * | 9/2014 | Krause | E04F 13/0817 | 52/506.08 |
| 10,443,234 | B2 | 10/2019 | Stronks et al. | | |
| 2008/0072532 | A1 | 3/2008 | Arias | | |
| 2008/0256882 | A1 | 10/2008 | Kidd | | |

FOREIGN PATENT DOCUMENTS

| | | | |
|---|---|---|---|
| CN | 103321434 | B | 5/2016 |
| CN | 105113671 | B | 6/2017 |
| CN | 108009364 | A | 5/2018 |
| CN | 207568022 | U | 7/2018 |
| CN | 207727820 | U | 8/2018 |
| CN | 207829241 | U | 9/2018 |
| CN | 207878718 | U | 9/2018 |
| CN | 208379867 | U | 1/2019 |
| CN | 208578220 | U | 3/2019 |
| CN | 208792581 | U | 4/2019 |
| CN | 109958215 | A | 7/2019 |
| CN | 209585382 | U | 11/2019 |
| GB | 928673 | A | 6/1963 |
| JP | H05331937 | A | 12/1993 |
| JP | H07217040 | A | 8/1995 |
| PL | 214455 | B1 | 8/2013 |
| WO | 2016060600 | A1 | 4/2016 |

OTHER PUBLICATIONS

03 Curved steel glass, downloaded from the Internet from: wallhttps://www.molon.de/galleries/Thailand/Bangkok/Suvarnabhumi/img.php?pic=3 on Nov. 20, 2019.

NorthGlass creates glass curatin wall for National Cybersecurity Base, Apr. 1, 2019, downloaded from the Internet from: http://www.northglass.global/News/detail/id/376.html on Dec. 11, 2019.

ASGG_18_Kazakhstan Pavilion_sphere and entrance pavilion at dusk, downloaded from the Internet from: https://archpaper.com/asgg_18_kazakhstan-pavilion_sphere-and-entrance-pavilion-at-dusk/ on Dec. 11, 2019.

The Future Music Center at Indian Hill, Indian Hill Music Center, Littleton, MA, downloaded from the Internet from https://indianhillmusic.org/new-music-center-2019-draft/ on Jan. 15, 2020.

The Future Music Center at Indian Hill, Indian Hill Music Center, Littleton, MA, downloaded from the Internet from https://indianhillmusic.org/new-music-center/ on Jan. 15, 2020.

Music Center at Indian Hill, Epstein Joslin Architects, downloaded from the Internet from https://www.epsteinjoslin.com/music-center-indian-hill on Jan. 15, 2020.

The Music Center at Indian Hill, BRA, downloaded from the Internet from https://www.brplusa.com/projects/music-center-indian-hill on Jan. 15, 2020.

Eike Schling, Martin Kilian, Hui Wang, Jonas Schikore, Helmut Pottmann, Design and Construction of Curved Support Structures with Repetitive Parameters, Advances in Architectural Geometry 2018 Sep. 2018, Chalmers University of Technology Gothenburg, Sweden, Klein Publishing GmbH.

* cited by examiner

MODULAR SYSTEM FOR GLAZING AND OTHER INFILL PANELS

BACKGROUND

The present disclosure relates to infill panel wall systems, for example, glazed infill panel wall systems.

Multistory commercial buildings often are covered by curtain walls. A curtain wall is a non-structural wall covering, typically glazed, that protects the building and its occupants from the outside environment. Curtain walls typically span multiple stories of a building and are connected horizontally to the building floors and vertically to the building columns. Wind loads and other forces are transferred from the curtain wall to the building structure.

Stick-built curtain walls are generally assembled on the job site using frame members or "sticks," typically made of aluminum. "Unitized curtain walls" are curtain wall structures that are built from prefabricated units or modules, typically at a factory.

Many modern buildings have complex outer facades covered by glass. These facades may be curved in both the vertical and horizontal planes. Curtain walls are typically built as planar structures. The planar structures of curtain walls can be pieced together to form simple curves in one dimension. More complex curves are often achieved by attaching planar or curved glass panels using structures other than curtain walls. For example, complex curves can be achieved using space frames as well as curved grid structures. A space frame is a three-dimensional structural framework typically constructed from a series of repeating geometric shapes connected rigidly to each other that transfer rotational, shear, and axial forces to adjoining elements. An example of a curved grid structure with glazing includes the Multihalle Mannheim, which includes a gridshell formed from elastically-bent timbers. A second example includes the Eiffel Tower Pavilions built from curved steel beams.

SUMMARY

The inventors noted existing glazed and infill panel structures with complex curves can be difficult and expensive to install and manufacture. These structures often require complex frames as described in the Background, and may also require curved glass or other curved infill panels. The inventors also noted straight sections and curved sections typically have different construction and generally do not have a consistent appearance.

The inventors set out to build a modular infill panel system with complex curves where the modular infill panel units could be premanufactured and then assembled on the jobsite into an infill or glazed panel wall. The inventors developed a modular infill panel system that includes individual modular infill panel units that utilize bracket assemblies. The bracket assemblies can include an angle bracket and two or more alignment pins projecting upward from the angle bracket. The angle bracket is secured to the top frame members of the structural frame of the modular infill panel unit. The alignment pins can be aligned widthwise across the top frame member and engage apertures in the bottom frame member of the structural frame of the upwardly-adjacent modular infill panel unit. The apertures are similarly positioned widthwise across the bottom frame member.

The angle bracket is positioned on the top frame member and structured in such a way that when the two or more alignment pins engage the apertures, the bottom frame member of the upper modular infill panel unit seats over the top frame member of the lower modular infill panel unit. In addition, adjacent sides of the structural frames that face the column or vertical building structure align in the same plane, allowing them to seat against the vertical building structure. Typically, this means that the inside edge of the junction between the upper leg and lower leg of the angle bracket would be mounted flush against one of the edges of the top frame member in order to align one side of the structural frame in the same plane as the corresponding side of the upwardly-adjacent structural frame. Before seating the upper modular infill panel unit, the upper leg of the angle bracket is fastened to an adjacent vertical joist, column, or horizontally-adjacent modular infill panel unit, in order to secure the lower modular infill panel unit to the vertical structure of the building.

The apertures in the bottom frame member can be circular or slotted. While circular apertures have greater precision, slotted apertures allow for differences in tolerances between the modular infill panel units. The alignment pins can be integrally extruded, cast, or otherwise formed with the angle bracket or can be separately manufactured and rigidly attached to the angle bracket. For example, the alignment pins can be threadedly fastened, welded, or otherwise ridgedly attached to the angle bracket.

Typically, the installer would attach a pair of bracket assemblies, each with two or more alignment pins to the floor or base level of the building structure. The bracket assemblies are spaced apart along the floor or base level of the building structure so that the two or more alignment pins on each bracket engage corresponding apertures positioned at opposite ends of the bottom frame member of the modular infill panel unit that seats against the floor. Since the brackets within the bracket assembly mounted against the floor do not need to attach to the vertical building structure, they do not need to be angle brackets. Once this modular infill panel unit engages the alignment pins mounted to the floor, and is mounted in place, the angle bracket that is mounted to the upper frame member of this first modular infill panel unit is secured to adjacent vertical joints, columns, or horizontally-adjacent modular infill panel units by threaded fasteners through the upper leg of the angle brackets. Once the first modular infill panel unit is secured, the installer can mount a second modular infill panel unit on top of the first modular infill panel unit. The installer aligns the apertures in the bottom frame member of the second modular infill panel unit with the alignment pins projecting upward from the angle brackets mounted on the top frame member of the first modular infill panel unit. Once the second modular infill panel unit is seated, the upper leg of the angle brackets mounted to the top frame member are secured to the vertically adjacent columns, joist, or horizontally-adjacent modular infill panel units. These steps are repeated up the rest of the structure.

The bracket assembly described above and throughout this disclosure could include other combinations of alignment pins and brackets that align the modular infill panel units and secure them to vertically adjacent columns, joints, or horizontally-adjacent infill panel units. For example, the bracket assembly could include a flat bracket mounted to the top frame member and a second flat bracket or strap attached to the side frame member directly adjacent to the flat bracket. The flat bracket can include the two or more alignment pins projecting upward from the top bracket. The second flat bracket or strap can project upward above the top frame member in a similar manner as the upper leg of the angle bracket. The second flat bracket could alternatively be rotated 90° rearward and project rearward from the modular infill panel unit. Alternatively, the bracket assembly could include a t-bracket with the center leg secured to the top frame member, the lower portion of the t-bracket secured to the side frame member, and the upper portion of the t-bracket projecting upward from the side frame member and above the top frame member. In this arrangement, the upper portion of the t-bracket can be secured to vertically adjacent columns, joints, or horizontally-adjacent infill panel units.

The modular infill panel units typically include a structural frame and an infill panel frame mounted to the frame surface of the structural frame. The infill panel frame holds the infill panel. A typical infill panel could be a glazed panel such as an insulated glass unit (IGU), an acrylic panel, or a single pane of glass. The infill panel could alternatively be a composite panel, stone, terracotta, aluminum, an aluminum composite panel, or other infill panels used for building facades. The structural frame can be made from wood, aluminum, steel, composite, fiber-reinforced plastic, or other materials capable of transferring gravity and wind forces to the columns, joists, or other horizontally-adjacent building frame vertical elements. The infill panel frames that can be mounted to the top surface of the structural frame can typically be made of metal such as aluminum or other materials that are capable of holding the corresponding infill panel. Creating a building facade with vertically stacked modular units using wood as their structural frame is challenging. One of the advantages of the inventor's modular infill panel system is the structural frame can be made out of wood. In order to create vertically curved structures, the bottom frame member and/or top frame members of the structural frames can be widthwise mitered along their length to achieve a desired angle. Alternatively, the top frame member can be widthwise angled compared to the bottom frame member in order (i.e., they can be widthwise-oblique with respect to each other) to achieve the same effect. In order to create horizontally curved structures, the structural frames, the infill panel frames, and the infill panels can be trapezoidal rather than just be restricted to rectangular shapes. Horizontally-adjacent modular infill panel units can have their facing edges shaped so that when joined together create the desired curve or shape. These adjacent modular infill panel units are typically joined together by a splice plate. The edge of the top frame members of both modular infill panel units that create the miter joint use bracket assemblies with flat brackets with alignment pins. The outer-most edges of the top frame members of both adjacent modular infill panel units use bracket assemblies with angle brackets. This allows complex shapes to be stacked during installation as previously described.

The modular infill panel units described above form a basis for the building of structures with complex three-dimensional curves and other shapes without the expense and complexity of space frames or grid shells. Like curtain walls, the modular infill panel units can attach to the building structure and transfer wind forces and other loads to the building structure. Curtain walls generally transfer forces through the top and bottom of the curtain wall structure to the horizontal framework of the building. Typically, these forces are transferred to the horizontal building floors. In contrast, the assembled modular infill panel units typically depend on connection only to vertical building structure such as columns and vertical joists. The out-of-plane forces are transferred to the building structure though the rigid connection of the structural frames of the modular infill panel units to the vertical building structure. The angle brackets transfer these out-of-plane forces and also act as a solid shim between modular infill panel units, transferring the gravity load to the modular infill panel units that are underneath the modular infill panel unit.

Because the system is supported by the building's vertical structure, one unexpected benefit is that it does not require connection to the roof or other horizontal building structures. This means the deflection and movement of the roof and intermediate building floors would not transfer their forces back into the modular infill panel structure. In contrast, because curtain walls are attached to roofs and intermediate floors of building structures, forces from movement of the floor or deflection of the roof can be transferred into the curtain wall. Since a curtain wall is a non-structural element, it typically is not designed to accommodate such forces. The modular infill panel system can be an advantage in locations with snow accumulation where the roof can sag or deflect under heavy snow. This is because the modular infill panel units do not need to be attached to the roof structure thereby decoupling the forces from the roof to the modular infill panel system. Similarly, the modular infill panel system can also be an advantage in areas of high seismic activity. During an earthquake or seismic event, the intermediate building floors can move up and down or shift. Since the modular infill panel units can be decoupled from the intermediate building floors, they are will not experience seismic stress from the floor movement.

The first application of the inventor's modular infill panel system is the Indian Hill Performance Hall at the Indian Hill Music Center in Groton, Mass., currently under construction at the time of this disclosure. In this application the infill panels were glazed panels in the form of an IGU. One of the unexpected results was that structural strength greatly exceeded design parameters. Before assembly, a mockup using some of the modular infill panel units was tested at National Certified Testing Laboratories on Oct. 16, 2019. The tests were performed in accordance with ASTM E283-04(12), ASTM E547-00(16), ASTM E331-00(16), and ASTM E330-14. Both the uniform load deflection test and uniform load structural test (ASTM E330-14) exceeded expected pressure by at least 75%. The water resistance test (ASTM E547-00(16) and ASTM E331-00(16)) exceeded expected pressure by at least 50%.

One of the important advantages of the inventors' modular infill panel system, is that flat sections, single curved sections, and multi-dimensionally curved sections can have a uniform appearance because each module has a similar construction whether used for curved or flat sections. This allows the two systems to be combined into a modular infill panel system with a uniform appearance that is independent of whether the surfaces are flat or curved. This is usually only achievable with space frames and other non-modular infill systems. This creates an important and distinct advantage for the present modular infill panel system.

This Summary introduces a selection of concepts in simplified form that are described in more detail in the Description. This Summary is not intended to identify essential features or limit the scope of the claimed subject matter.

DRAWINGS

DESCRIPTION

The terms "left," "right," "top, "bottom," "upper," "lower," "front," "back," and "side," are relative terms used throughout this disclosure to help the reader understand the figures. Unless otherwise indicated, these do not denote absolute direction or orientation and do not imply a particular preference. When describing the figures, the terms "top," "bottom," "front," "rear," and "side," are from the perspective of standing outside the building structure and looking toward the structure. Specific dimensions and angles are intended to help the reader understand the scale and advantage of the disclosed material. Dimensions given are typical and the claimed invention is not limited to the recited dimensions. For the purposes of this disclosure, the word "approximately" or "proximate" is taken to have the ordinary meaning to one skilled in the art. For example, it can mean within a normal manufacturing or installation tolerance or variance.

Figure 1:
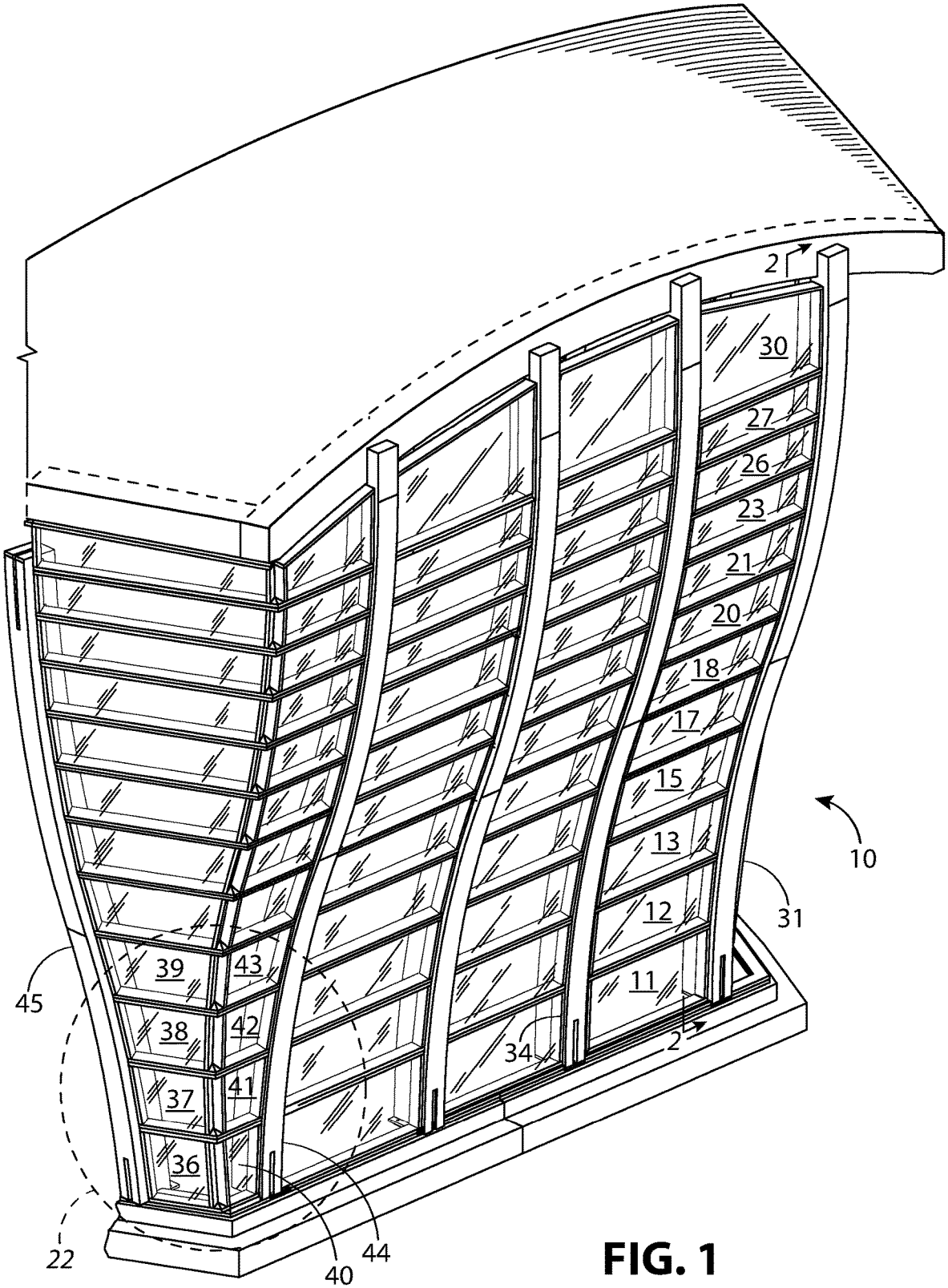
FIG. 1 illustrates in top perspective view a portion of a typical infill panel wall section utilizing principles described within this disclosure.
Figure 2:
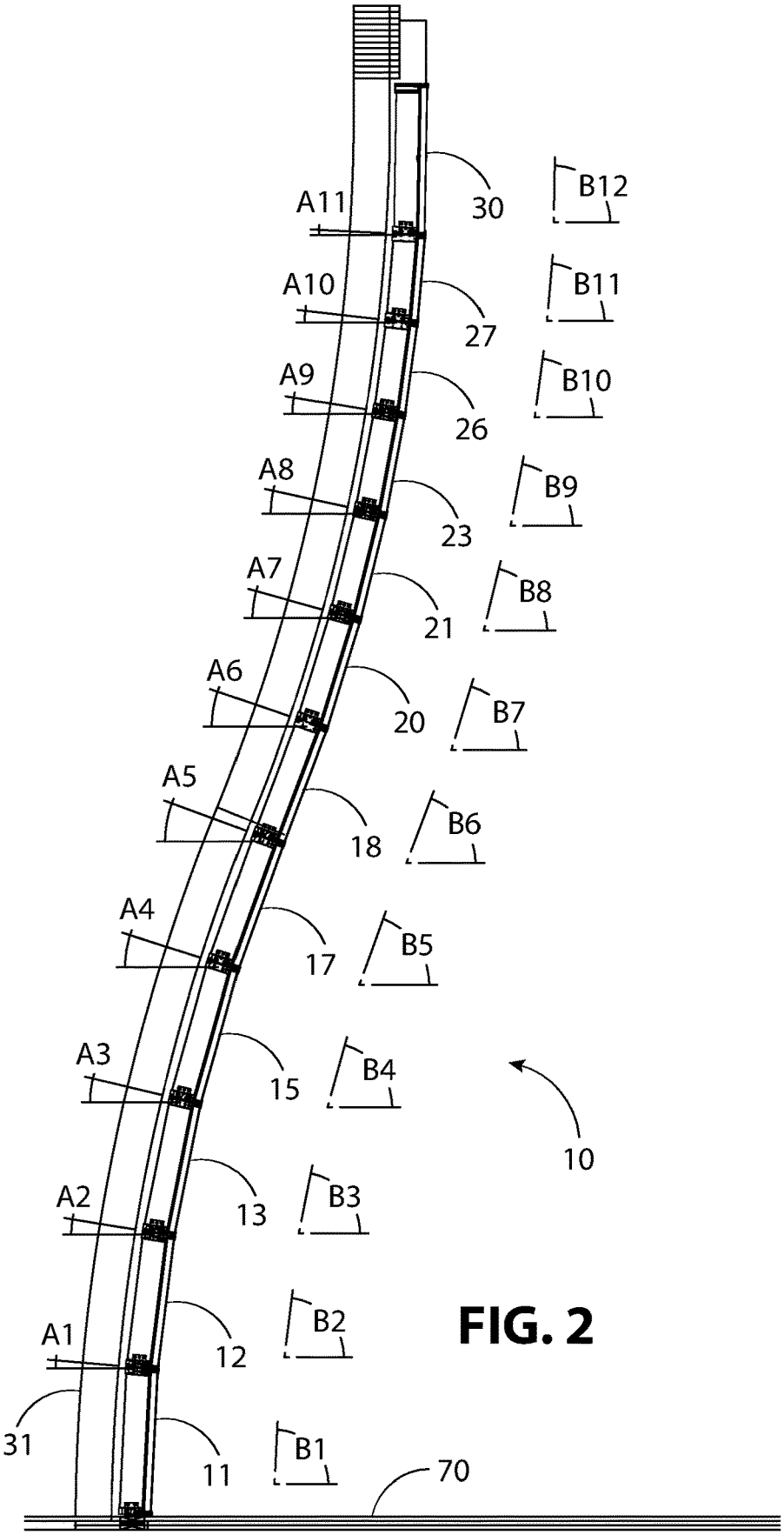
FIG. 2 illustrates a section view of FIG. 1 taken along section lines 2-2.
Figure 3:
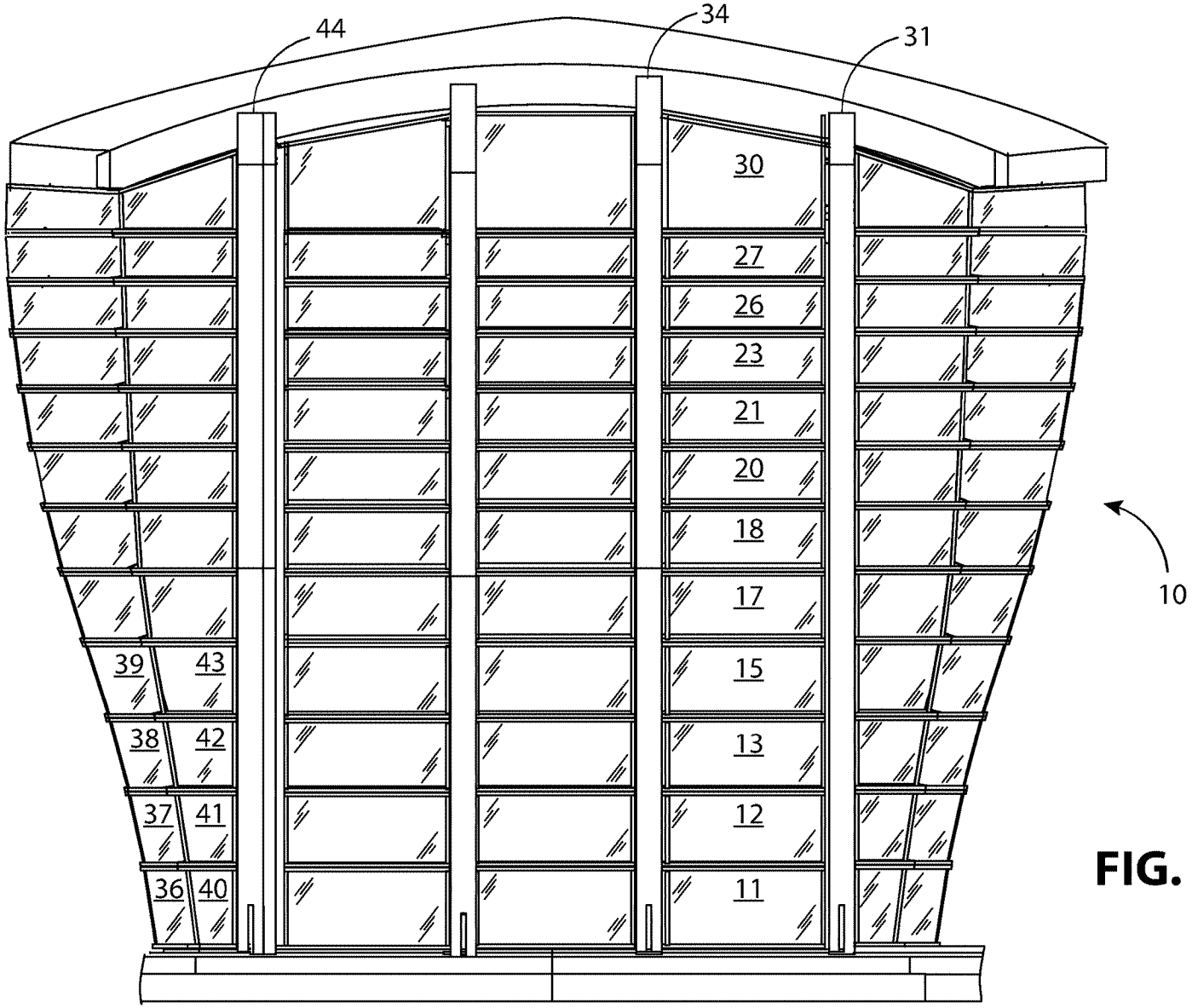
FIG. 3 illustrates a front elevation view of FIG. 1.

The inventors set out to build a modular infill panel system where the modular infill panel units could be premanufactured and then easily assembled into a glazed wall system onsite. The infill panel wall system could be planar or include curved surfaces in one or more planes. FIGS. 1-3 illustrate a typical application of the inventors' modular infill panel system, modular infill panel system 10, as installed at the Indian Hill Performance Hall at the Indian Hill Music Center in Groton, Mass. The modular infill panel system 10, as illustrated in FIGS. 1-3, include modular infill panel units 11, 12, 13, 15, 17, 18, 20, 21, 23, 26, 27, 30 that are vertically stacked and secured to columns 31 and column 34 (FIGS. 1 and 3). This creates a curve in the vertical plane. The modular infill panel system 10, as illustrated in FIGS. 1 and 3, also includes modular infill panel units 36, 37, 38, 39, 40, 41, 42, 43 that in combination create complex three-dimensional curves. Modular infill panel units 36, 37, 38, 39 are horizontally-adjacent to modular infill panel units 40, 41, 42, 43, respectively and each horizontally-adjacent pair is secured to column 44 and column 45 (FIG. 1). The infill panels in this installation are glazed panels in the form of IGUs. However, as the reader will learn from this disclosure, they are not limited to glazed panels.

Before installation of the modular infill panel system 10, at the Indian Hill Music Center, a mockup using some of the modular infill panel units was tested at National Certified Testing Laboratories on Oct. 16, 2019. The tests were performed in accordance with ASTM E283-04(12), ASTM E547-00(16), ASTM E331-00(16), and ASTM E330-14. Both the uniform load deflection test and uniform load structural test in accordance with ASTM E330-14 exceeded expected pressure values by at least 75%. In the uniform load deflection test, the test system showed no damage after positive and negative deflection of 3360 Pa (70.18 psf). The expected value was 1920 Pa (40.10 psf). Similarly, the test system showed no damage under the uniform load structural test at 5040 Pa (105.26 psf) in accordance with ASTM E330-14. The expected value was greater than 2880 Pa (60.15 psf). Water leakage resistance was measured in accordance to ASTM E547-00(16) and ASTM E331-00(16). The water resistance test showed no leakage after four cycles of 5 minutes at 1436 Pa (30 psf). This was 50% above the expected value of 718 Pa (15 psf). Referring to FIG. 8, the better-than-expected water leakage performance may be attributable to the infill panel frame 49 attaching to the front surface 48*a*, of the structural frame 48. And, in FIG. 7, the infill panel 47, which for the mockup test, and in the installation at Indian Hill, is a glazed panel in the form of an IGU inserted into the infill panel frame 49 and waterproofed by silicone.

Figure 5:
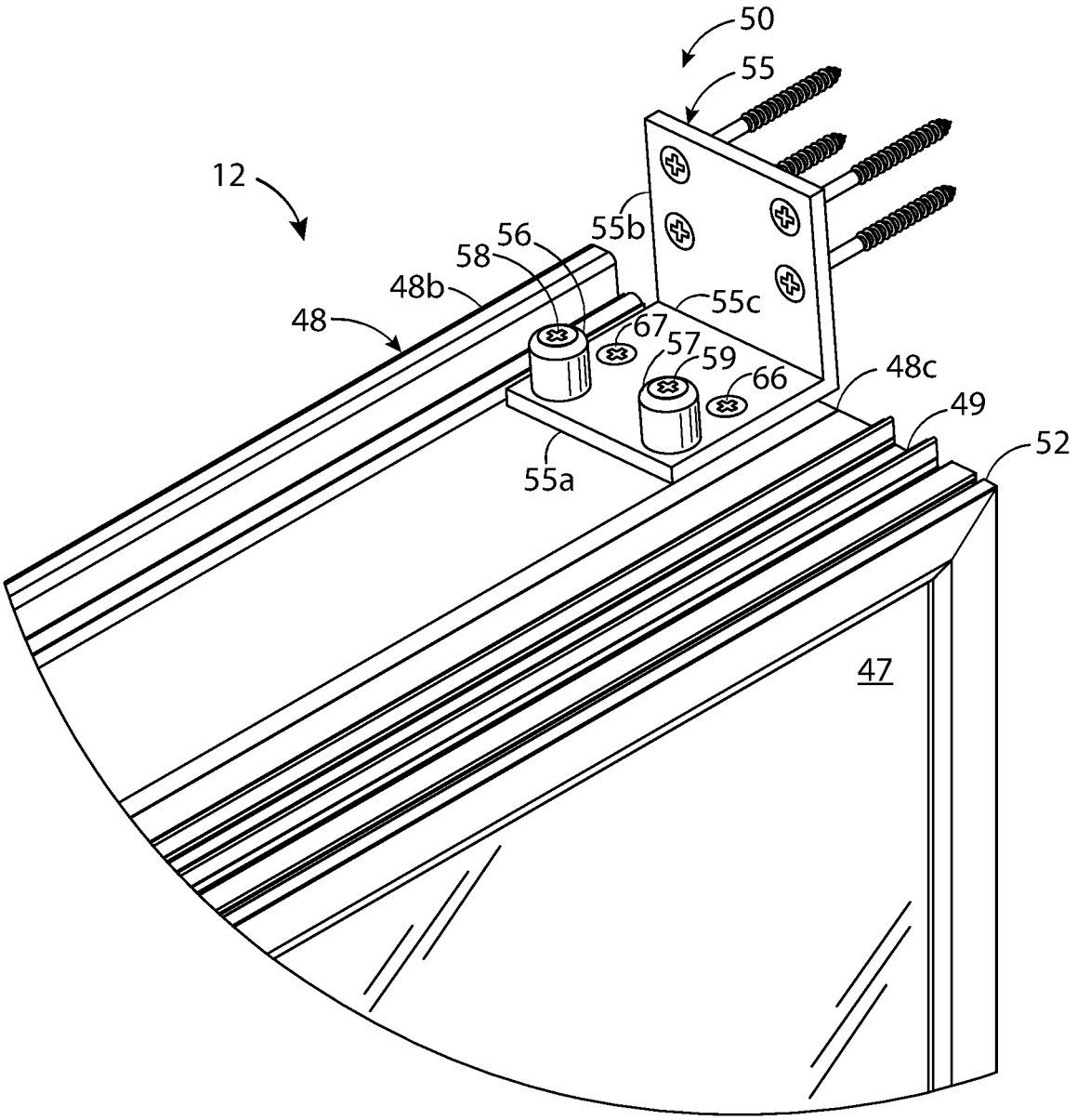
FIG. 5 illustrates a portion of FIG. 4 enlarged for magnification purposes and showing the bracket assembly.
Figure 6:
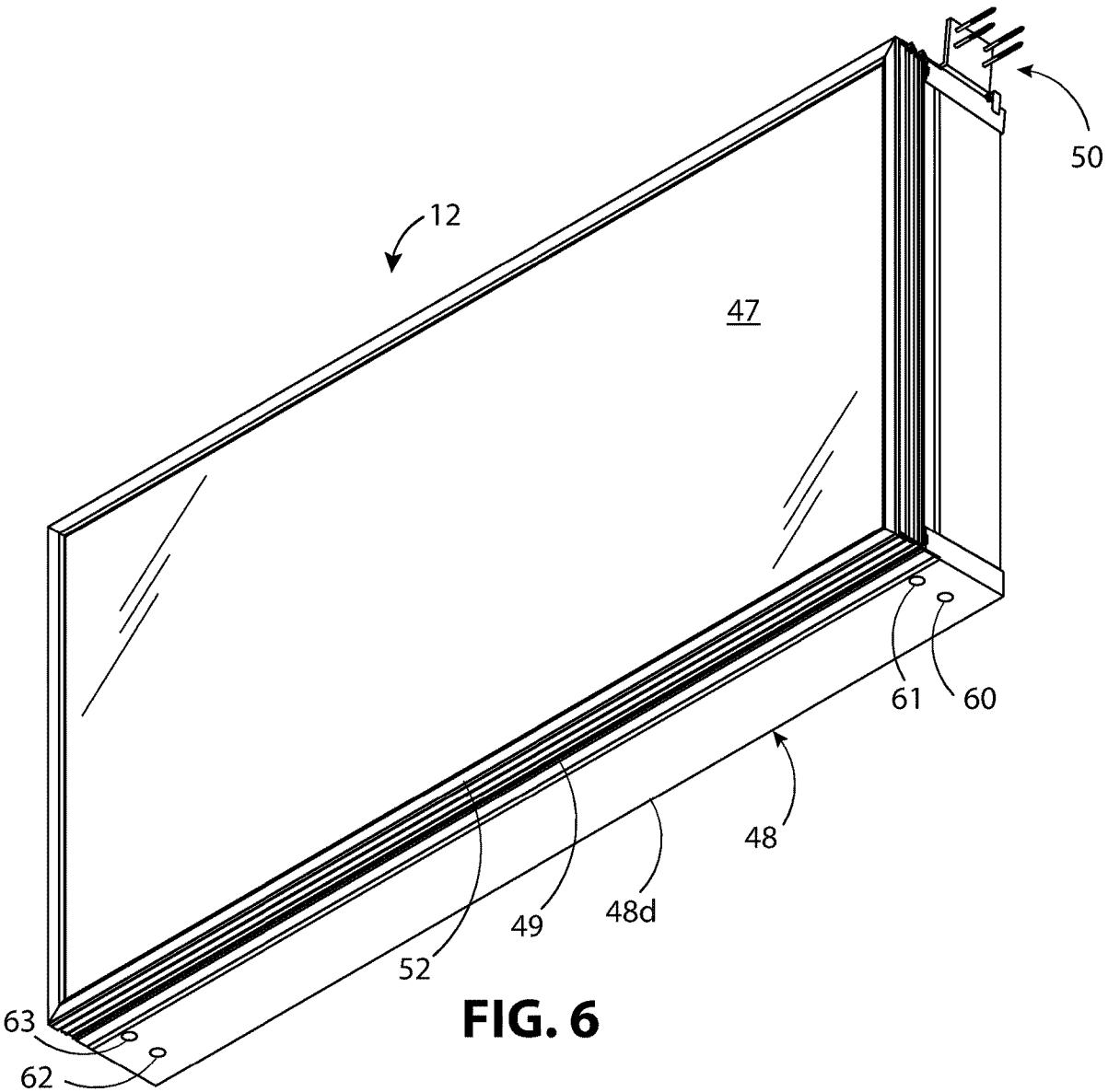
FIG. 6 illustrates the modular infill panel unit of FIG. 4 in front and bottom perspective view.
Figure 7:
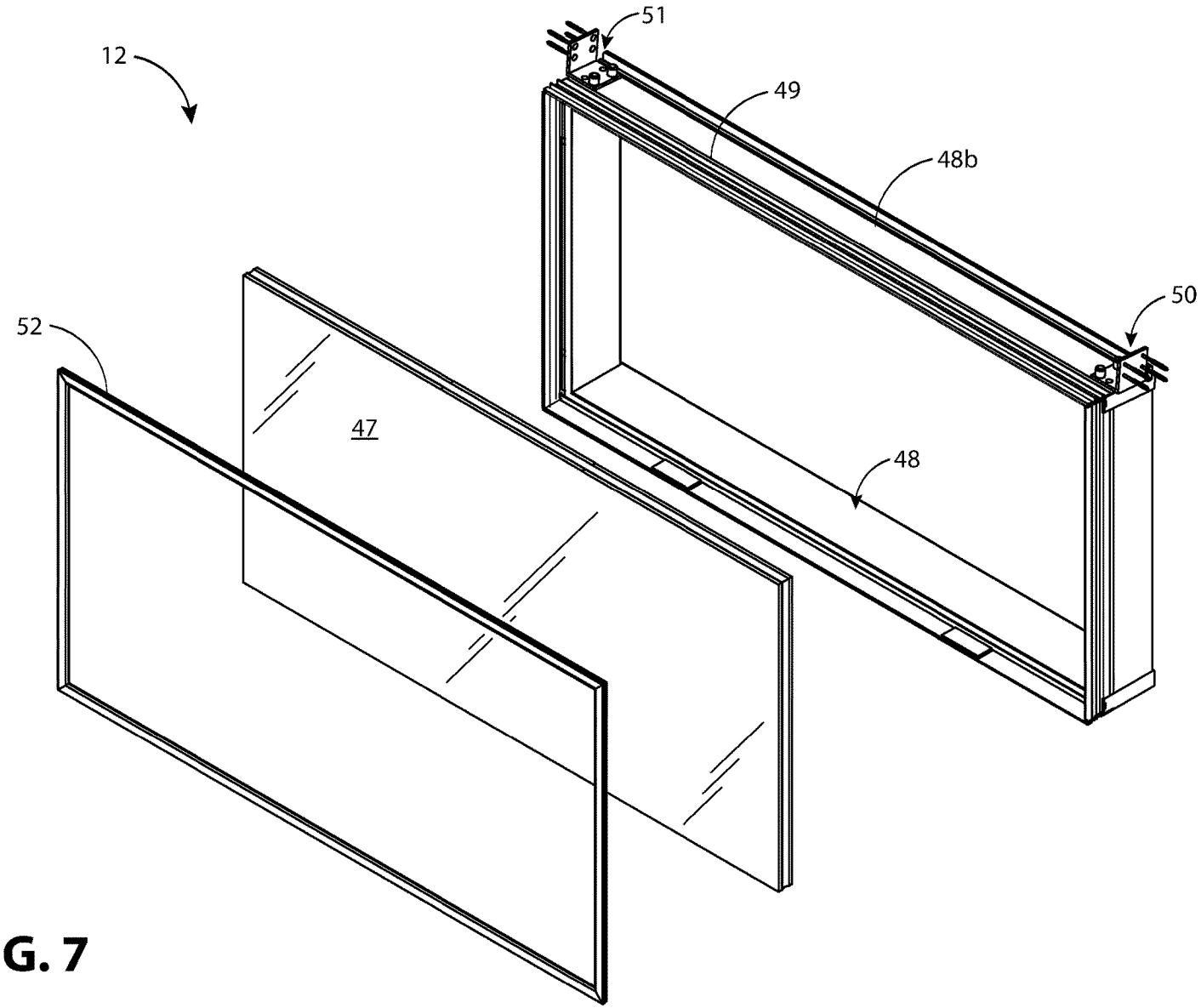
FIG. 7 illustrates a partially exploded view of FIG. 4 showing the infill panel and infill panel outer frame exploded away from the modular infill panel unit frame assembly.
Figure 8:
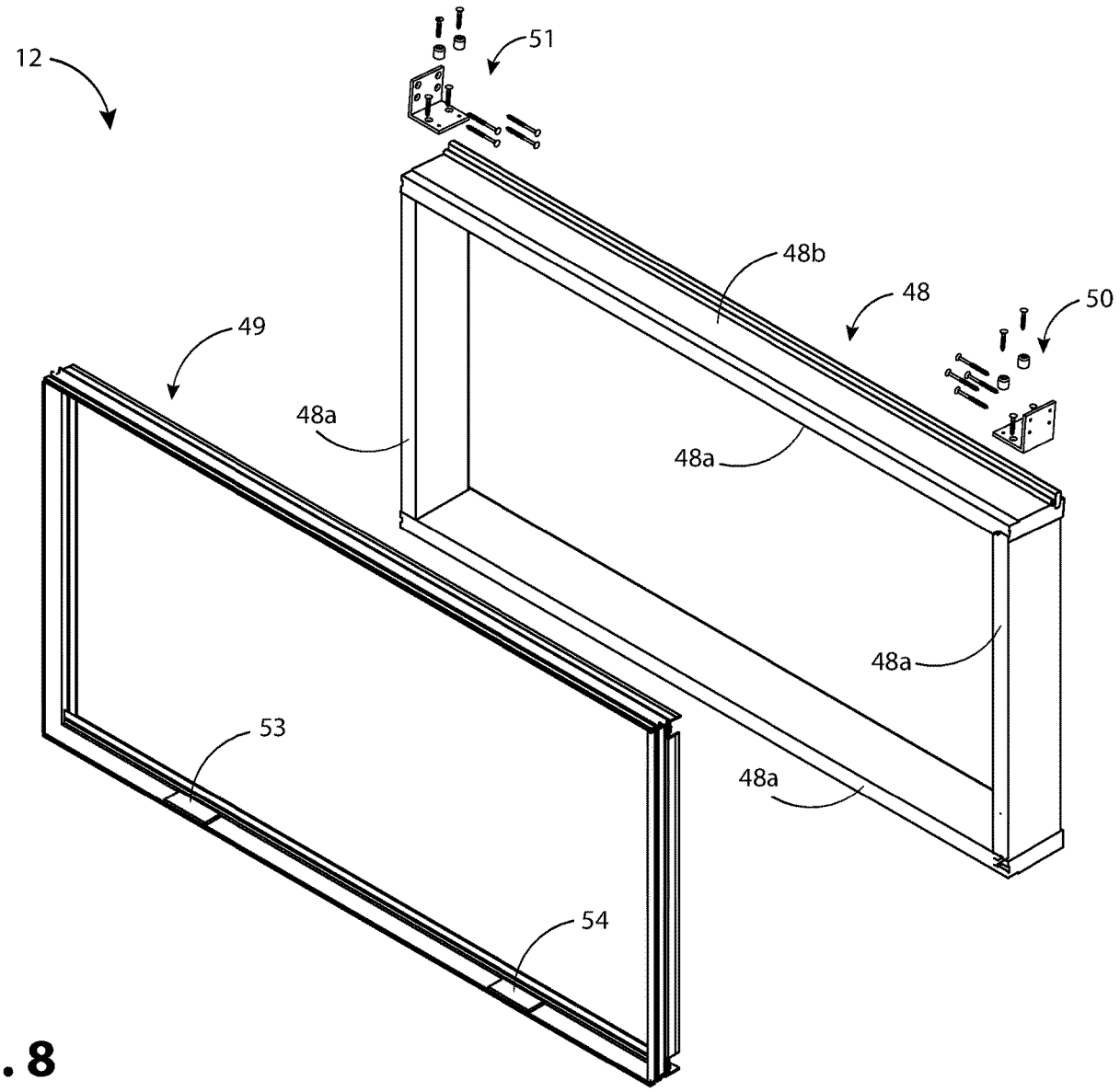
FIG. 8 illustrates a partially exploded view of the modular infill panel unit frame assembly with the infill panel frame and the bracket assemblies exploded away from the structural frame.
Figure 9:
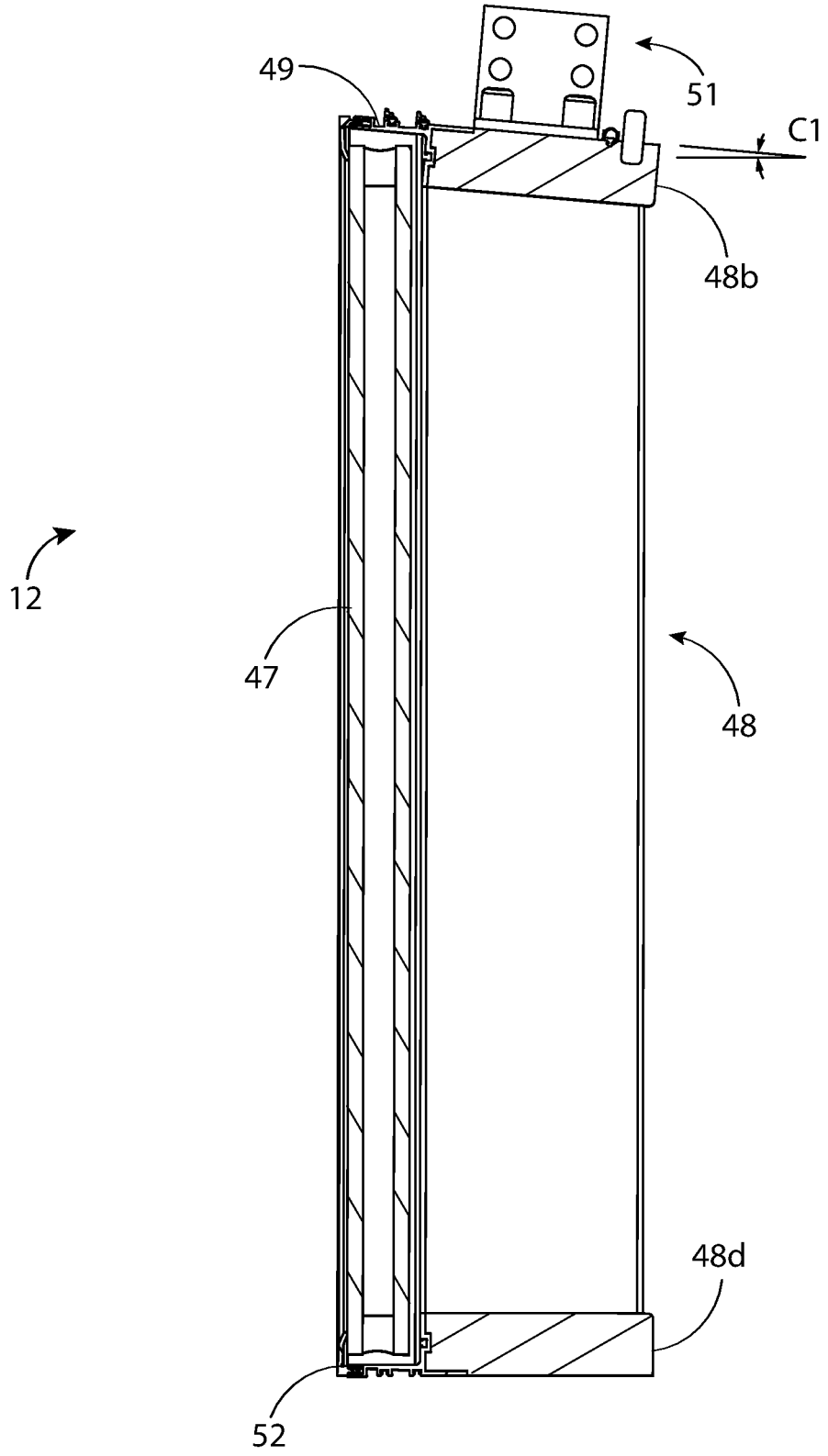
FIG. 9 illustrates a section view of FIG. 4 taken along section lines 9-9.

FIGS. 4-9 illustrate the construction of the modular infill panel unit 12. Modular infill panel unit 12 is illustrative of a building block that can be used for creating vertically stacked modular infill panel units that together can form a curved surface in the vertical plane. Referring to FIGS. 4-9, the modular infill panel unit 12 can include an infill panel 47, a structural frame 48, an infill panel frame 49, a first bracket assembly 50, a second bracket assembly 51, and optionally, an infill panel gasket 52. One of the advantages of this modular infill panel system is that the structural frame 48 can be made of any material capable of transferring gravity loads downward and out-of-plane loads to the vertical columns. For example, the structural frame can be made of aluminum, steel, composite, or wood. In the Indian Hill Performance Center, the structural frame of each modular infill panel unit is made from wood. Working with wood to create the finished appearance at the Indian Hill Performance Center was challenging. The inventors believe that one of their contributions to the art, is creating a vertically stacked modular structure made from wood structural members that transfers loads to vertically adjacent building frame elements. Referring to FIG. 8, the infill panel frame 49 attaches to the front surface 48*a* of the structural frame 48. Referring to FIGS. 7 and 9, the infill panel 47, which is illustrated as a glazed panel in the form of an IGU, can typically be held to the infill panel frame 49 by a combination of silicon and setting blocks. The silicon can optionally be covered by the infill panel gasket 52. Setting blocks 53, 54 are illustrated in FIG. 8 and are typical of what could be used. Setting blocks 53, 54 are typically used to dampen vibrational transfer to IGUs and other glazed panels. Setting blocks can be made of neoprene, ethylene propylene diene monomer (EPDM), or silicone. For infill panels made of aluminum, composite, or other materials that are not prone to breakage from vibration, setting blocks may not be necessary.

Figure 4:
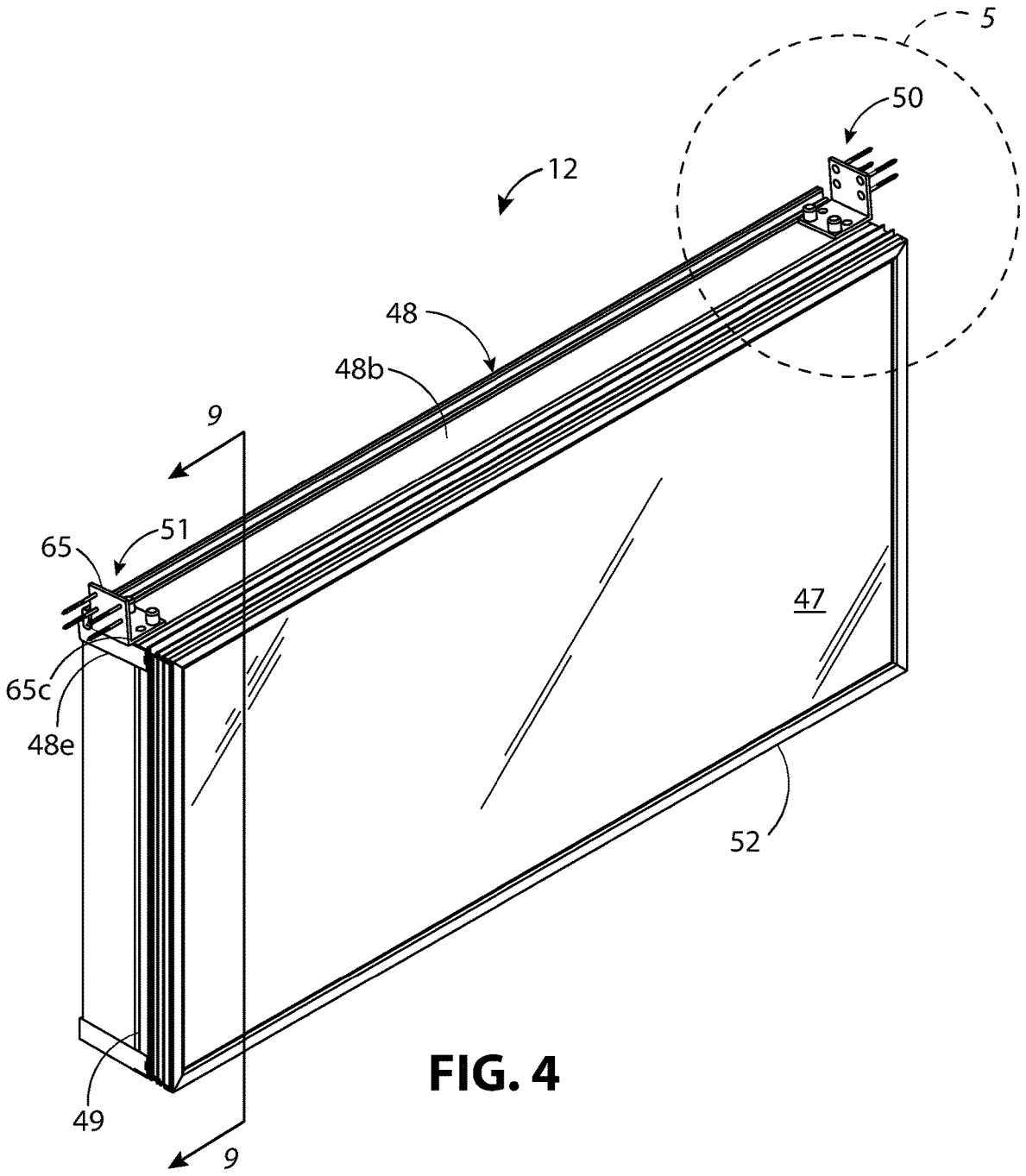
FIG. 4 illustrates a modular infill panel unit from FIG. 1 in front and top perspective view.

Referring to FIGS. 4, 7, and 8, the first bracket assembly 50 and the second bracket assembly 51 are attached to the top frame member 48*b* of the structural frame 48 at opposite lengthwise ends. FIG. 5 illustrates a portion of FIG. 4 illustrating the relationship between the first bracket assembly 50 and the top frame member 48*b*. The first bracket assembly 50, as illustrated, includes an angle bracket 55 and alignment pins 56, 57. The angle bracket 55 includes a lower leg 55*a* and an upper leg 55*b* projecting upward and away from the lower leg 55*a*. The alignment pins are aligned widthwise across the top frame member 48*b* of the structural frame 48. The alignment pins 56, 57 each project upward from the angle bracket 55. They can be secured to the angle bracket 55 by threaded fasteners, for example, threaded fasteners 58, 59 as illustrated, or otherwise rigidly secured to the angle bracket 55. For example, the alignment pins 56, 57 can be rigidly secured to the angle bracket 55 by welding, riveting, or can be integrally formed with the angle bracket 55 by extrusion or casting. The alignment pins 56, 57 are illustrated extending widthwise across the top frame member 48*b*. The alignment pins 56, 57 engage corresponding apertures in the bottom frame member of the upwardly-adjacent modular infill panel unit. FIG. 6 illustrates the apertures 60, 61, 62, 63 in the bottom frame member 48*d* of modular infill panel unit 12. Apertures 60, 61 are sized and spaced apart from each other to receive the alignment pins projecting upward from a vertically adjacent modular infill panel unit positioned below the modular infill panel unit 12. In FIG. 6, the apertures 60, 61 are aligned widthwise across the bottom frame member 48*d*. Apertures 62, 63 are similarly sized, spaced apart, and aligned. In the example of FIGS. 1-3, this would be modular infill panel unit 11. While the apertures 60, 61, 62, 63 are illustrated as circular, they can also be slotted. Circular apertures create more precise alignment. Slotted apertures allow adjustment for manufacturing tolerances. The reader may choose according to what suits their installation requirements.

As illustrated in FIG. 5, the lower leg 55*a* and the upper leg 55*b* can be an L-shaped bracket with an angle between lower leg 55*a* and the upper leg 55*b* of approximately 90° (i.e. a right-angle bracket). The inside edge 55*c* between the lower leg 55*a* and the upper leg 55*b* can be aligned as illustrated along the first edge 48*c* of the top frame member 48*b*. The angle bracket 55 can be secured to the top frame member 48*b* by threaded fasteners. For example, threaded fasteners 58, 59, 66, 67 as illustrated. Referring to FIG. 4, the inside edge 65*c* of the angle bracket 65 can be similarly aligned with the second edge 48*e* of the top frame member 48*b*. The edge alignment described above for angle brackets 55, 65 allows the next vertically adjacent modular infill panel unit (i.e. it aligns adjacent sides of the structural frames) to maintain a vertical sightline along the vertical plane. Referring to the example installation of FIGS. 1-3, the next vertically adjacent modular infill panel units above and below would be the modular infill panel unit 13 and modular infill panel unit 11, respectively. Note that in FIG. 3 the linear vertical sightline is maintained throughout the modular infill panel units 11, 12, 13, 15, 17, 18, 20, 21, 23, 26, 27, 30.

Referring to FIG. 9, the top frame member 48*b* and/or the bottom frame member 48*d* can have a widthwise-oblique angle with respect to each. This causes the front faces of the modular infill panel unit 12 and a vertically adjacent modular glazing unit, such as modular infill panel unit 13 of FIGS. 1-3, to form an oblique angle. For example, the top frame member 48*b* and/or the bottom frame member 48*d* can be widthwise mitered or alternatively widthwise angled along their length in order to create a piecewise curve along the vertical plane. For example, in FIG. 9, the top frame member 48*b* is at a widthwise-oblique angle C1 while the bottom frame member 48*d* remains flat. This is just one example. The bottom frame member 48*d* could be at a widthwise-oblique angle with the top frame member 48*b* remaining flat. Alternatively, both the top frame member 48*b* and the bottom frame member 48*d* can be at a widthwise-oblique angle with respect to the horizon and be at a widthwise-oblique angle with respect to each other. To illustrate how this could create a curved wall surface, we refer to FIG. 2. FIG. 2 illustrates a section view taken along section lines 2-2 in FIG. 1. In FIG. 2, the angle between modular infill panel units 11, 12 is illustrated by angle A1, between modular infill panel units 12, 13 is illustrated by angle A2, between modular infill panel units 13, 15 is illustrated by angle A3, between modular infill panel units 15, 17 is illustrated by angle A4, between modular infill panel units 17, 18 is illustrated by angle A5, between modular infill panel units 18, 20 is illustrated by angle A6, between modular infill panel units 20, 21 is illustrated by angle A7, between modular infill panel units 21, 23 is illustrated by angle A8, between modular infill panel units 23, 26 is illustrated by angle A9, between modular infill panel units 26, 27 is illustrated by angle A10, and between modular infill panel units 27, 30 is illustrated by angle A11. Angles A1, A2, A3, A4, A5, A6, A7, A8, A9, A10, A11 create corresponding angles between the plane of each infill panel and the horizontal, angles B2, B3, B4, B5, B6, B7, B8, B9, B10, B11, respectively as well as angle B1 and the floor 70.

Figure 10:
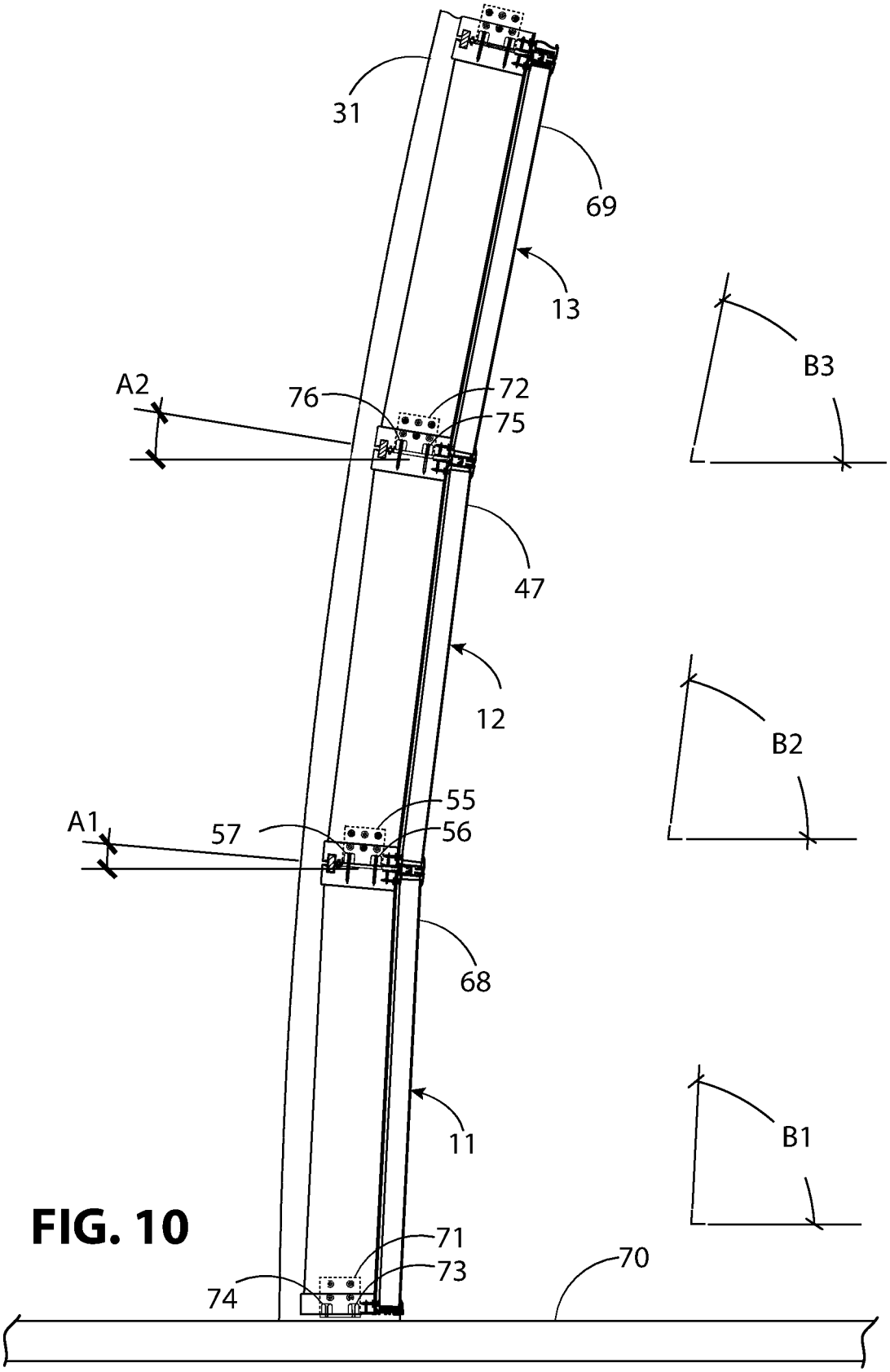
FIG. 10 illustrates a lower portion of FIG. 2 enlarged for magnification purposes and showing the lower three modular infill panel units.

FIG. 10 shows this in greater detail. FIG. 10 illustrates the lowest three of the modular infill panel units 11, 12, 13 and the corresponding lower portion of column 31, of FIG. 2. FIG. 10 illustrates the relationship between infill panels 68, 47, 69 of the modular infill panel units 11, 12, 13, respectively. Also illustrated is the relationship between angle brackets 71, 55, 72 and corresponding alignment pins, the alignment pins 73, 74, 56, 57, 75, 76 in relation to upwardly-adjacent modular infill panel units. FIG. 10 illustrates in greater clarity the angle A1 between modular infill panel units 11, 12, the angle A2 between modular infill panel units 12, 13 as well as the corresponding angles B2, B3 with respect to the horizon. It also illustrates the angle between the face of the infill panel 68 and the floor 70, which is angle B1. The modular infill panel units 11, 12, 13 form a concave curve with respect to the outside environment. Referring to FIG. 2, in contrast, the modular infill panel units 20, 21, 23, 26, 27 form a convex curve with respect to the outside environment. The overall curve in FIG. 2 is serpentine in shape. This is just one example of piecewise linear curves that are possible by creating a widthwise-oblique angle between the top frame member and the bottom from member within a modular glazing panel unit and/or varying the angles between the top frame member of the modular infill panel unit and bottom frame members of the corresponding upwardly-adjacent modular infill panel unit.

Figure 11:
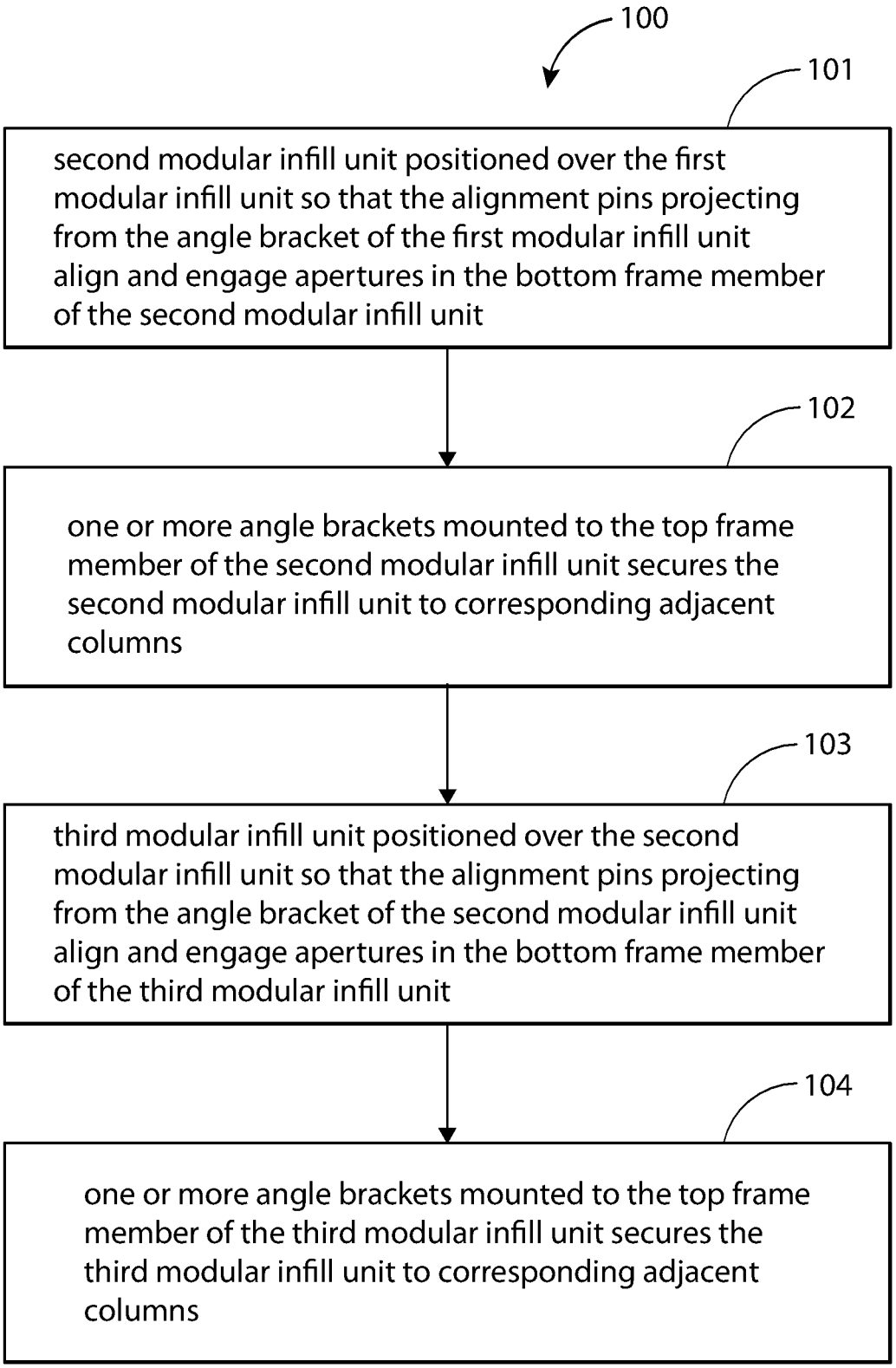
FIG. 11 illustrates a simplified assembly flow chart.
Figure 12:
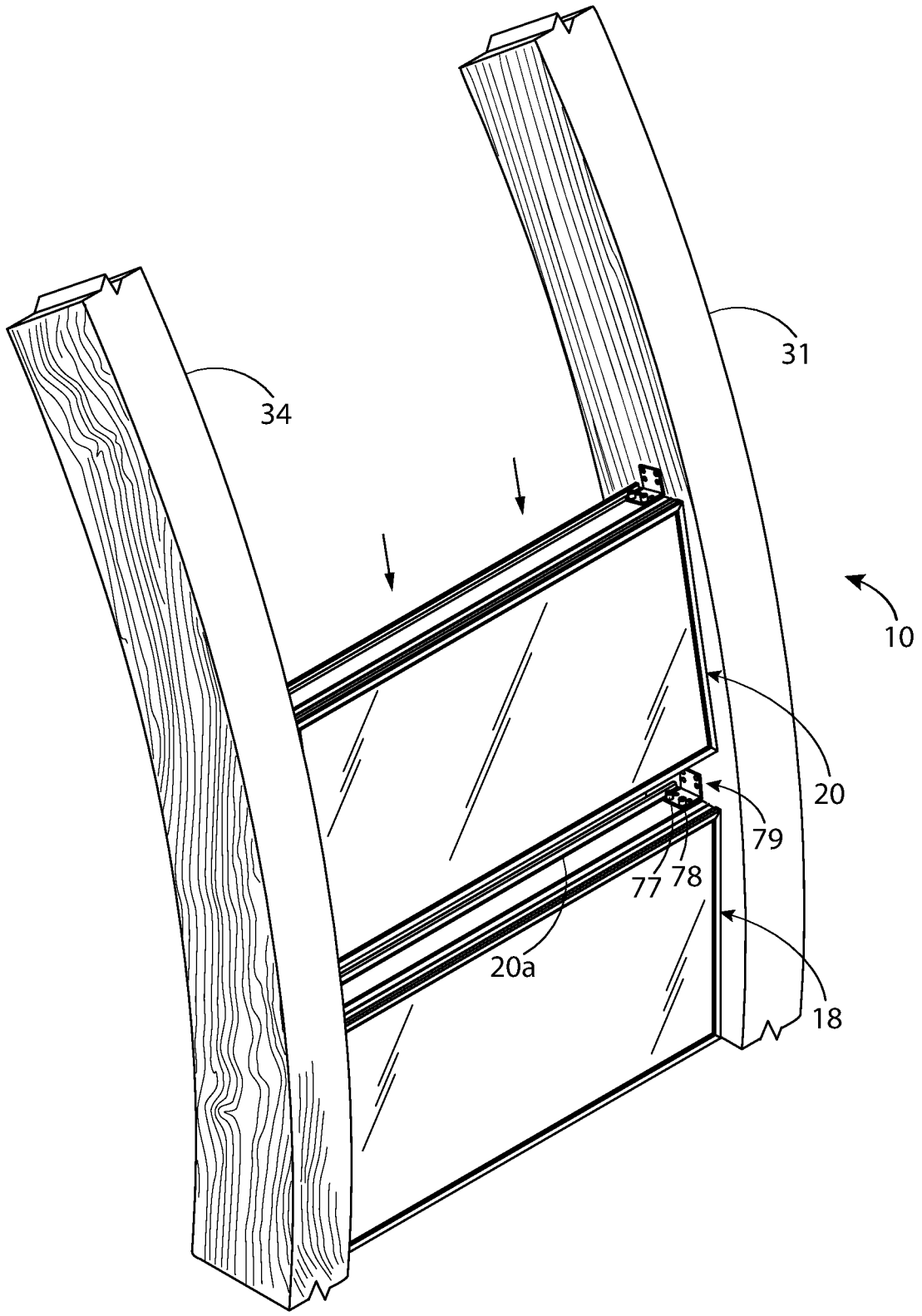
FIG. 12 illustrates a right-side upper portion of FIG. 2, in top and left perspective view showing a typical assembly step of stacking two of the modular infill panel units.

In order to better understand the relationship between the modular infill panel assemblies, FIGS. 12-20 together show a typical simplified assembly sequence of the modular infill panel units. Referring to FIGS. 13, 15, 18, and 20, this includes modular infill panel units 18, 20, 21 in combination with columns 31, 34. The principles of this assembly sequence can apply generally to assembling modular infill panel units of the present disclosure along vertical planes. FIG. 11 is a flow chart 100 showing typical assembly steps. When referring to FIG. 11 in combination with any of the FIGS. 12-20, numerically referenced assembly steps will refer to FIG. 11. Numerically referenced structural combinations will refer to the other referenced figures. Referring to FIGS. 11 and 12 in step 101 the modular infill panel unit 20 is positioned over modular infill panel unit 18 so that apertures (not shown) in the bottom frame member 20*a* of modular infill panel unit 20, are aligned over the alignment pins 77, 78 of the first bracket assembly 79 and the alignment pins of the second angle bracket assembly (hidden from view in FIG. 12). Once positioned, the modular infill panel unit 20 is seated against modular infill panel unit 18 with the alignment pins 77, 78 of the first angle bracket positioned within the corresponding apertures in the bottom frame member 20*a*.

Figure 13:
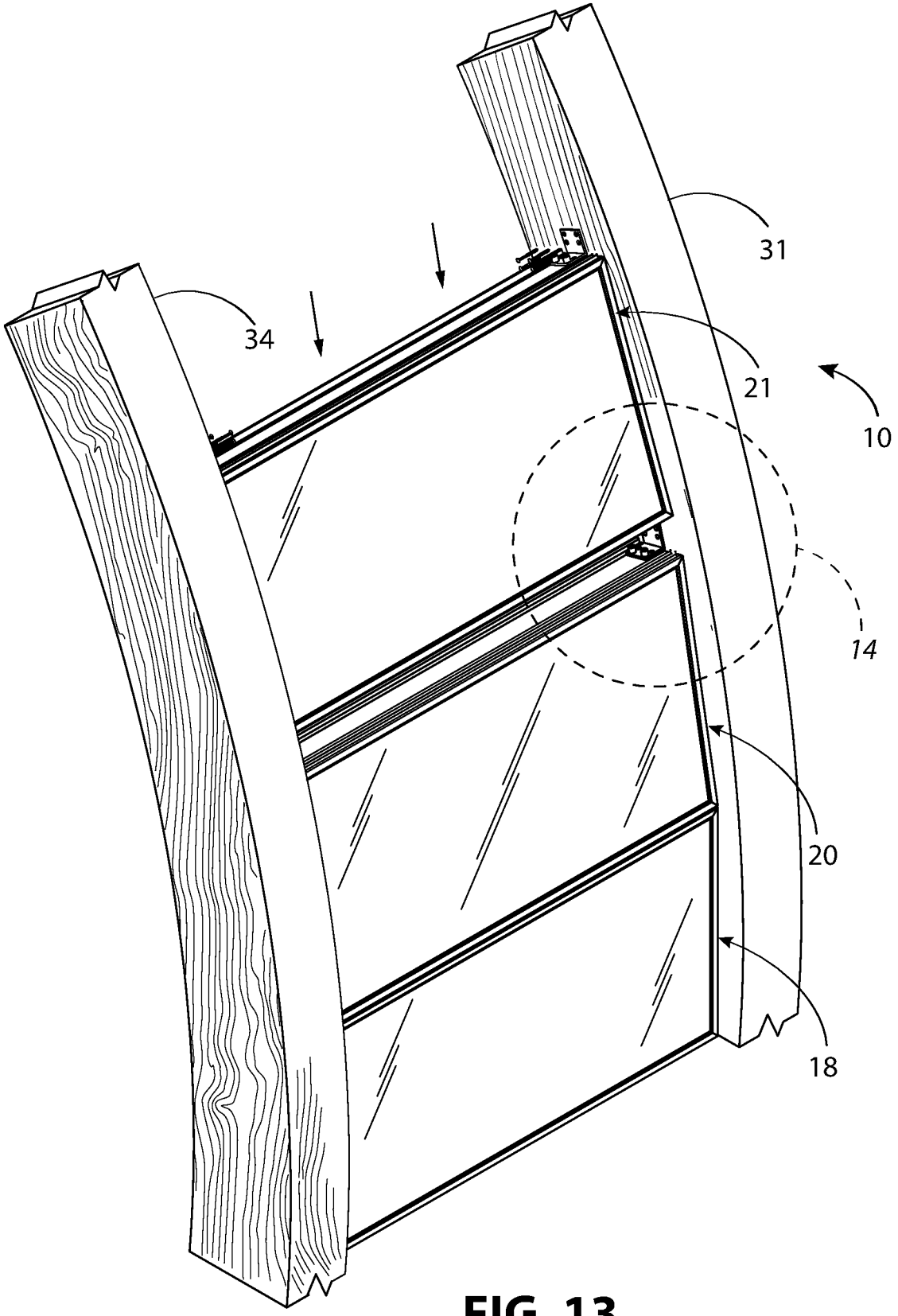
FIG. 13 illustrates in top and left perspective view, the addition of a third modular infill panel unit to FIG. 12.
Figure 14:
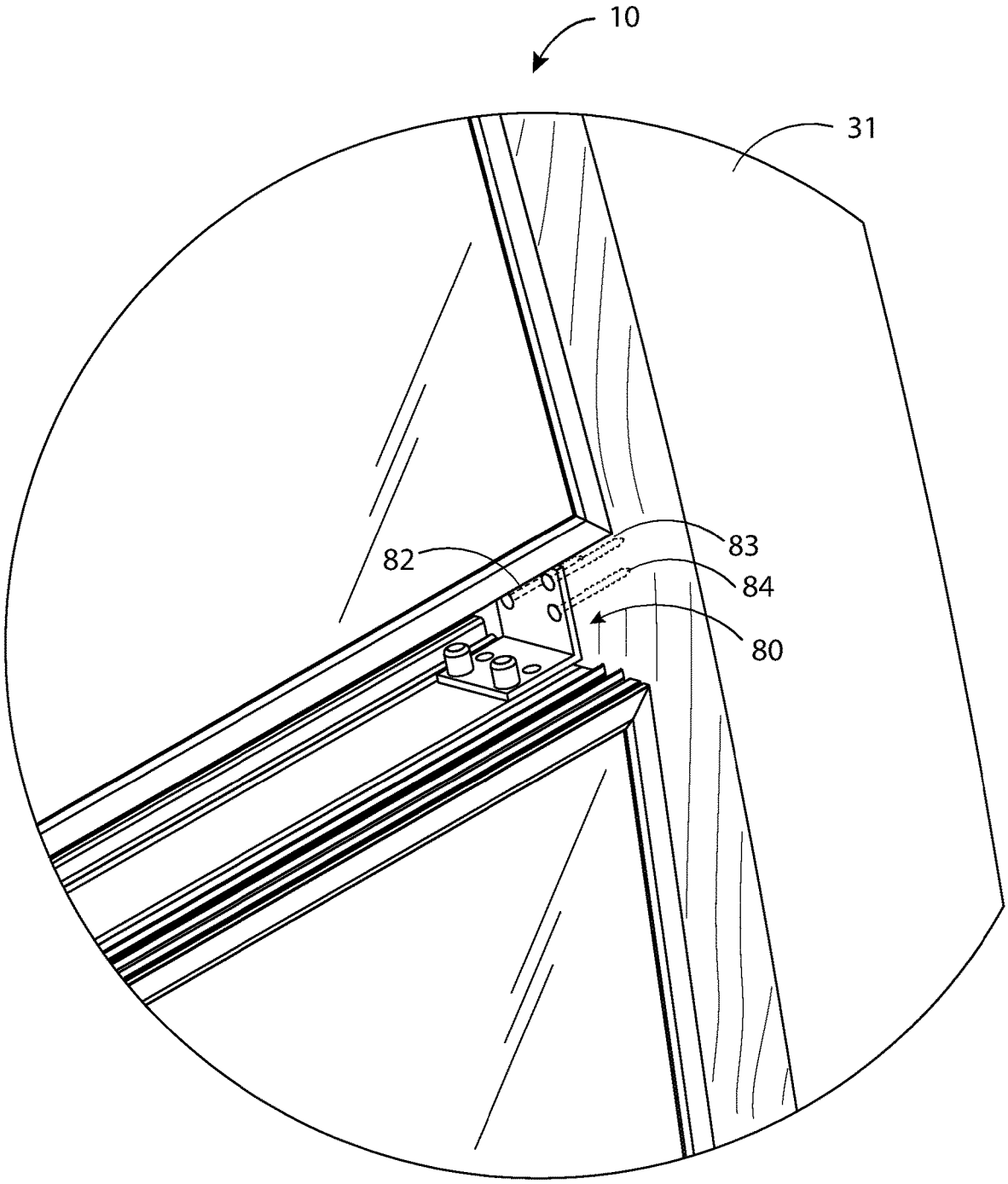
FIG. 14 illustrates a portion of FIG. 13, enlarged for magnification purposes, and showing a first bracket assembly attached to the second of the three modular infill panel units of FIG. 13.
Figure 15:
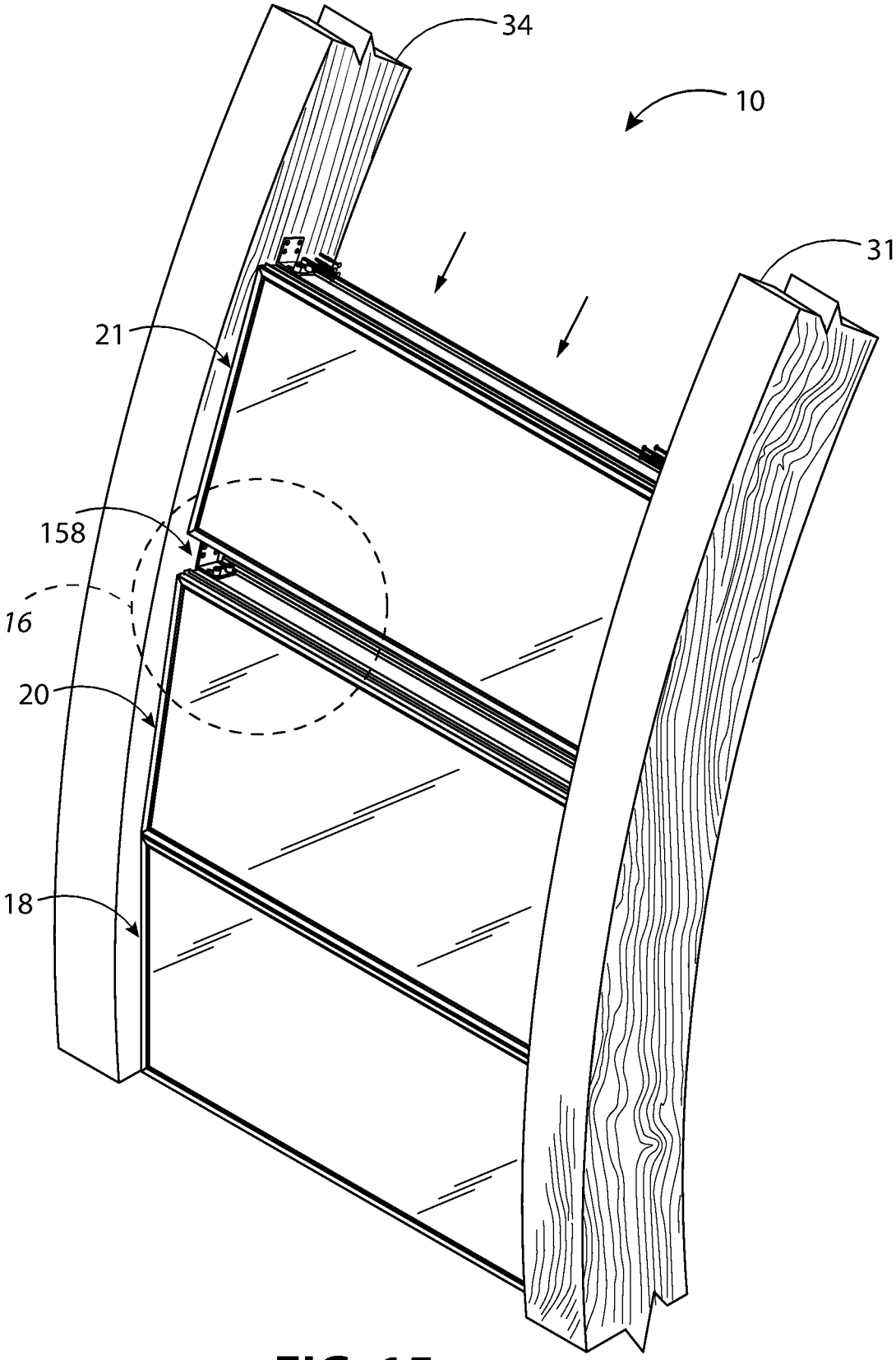
FIG. 15 illustrates FIG. 13 in right and top perspective view.
Figure 16:
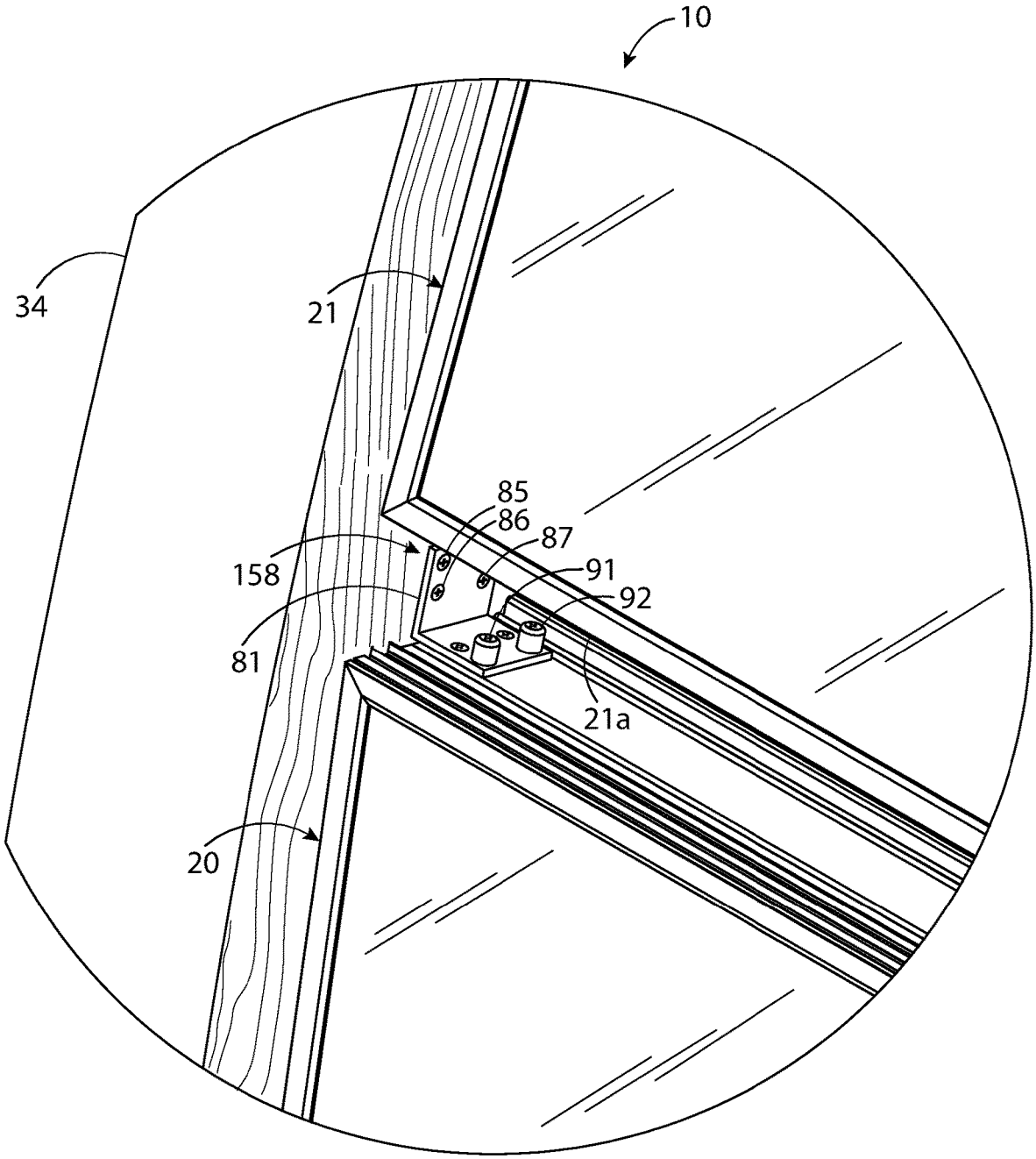
FIG. 16 illustrates a portion of FIG. 15 enlarged for magnification purposes showing a second bracket assembly attached to the second of the three modular infill panel units.

Referring to FIGS. 11, 13, and 14, in step 102, modular infill panel unit 20 is secured to column 31 by threaded fasteners securing the first bracket assembly 80 to the column 31. Referring to FIGS. 11, 15, and 16, similarly, the modular infill panel unit 20 is secured to column 34 by threaded fasteners securing the second angle bracket of the second bracket assembly 158 to column 34. FIG. 14 shows threaded fasteners 82, 83, 84 securing the first bracket assembly 79 to column 31. FIG. 16 shows threaded fasteners 85, 86, 87 securing the second bracket assembly 158 to column 34.

Figure 17:
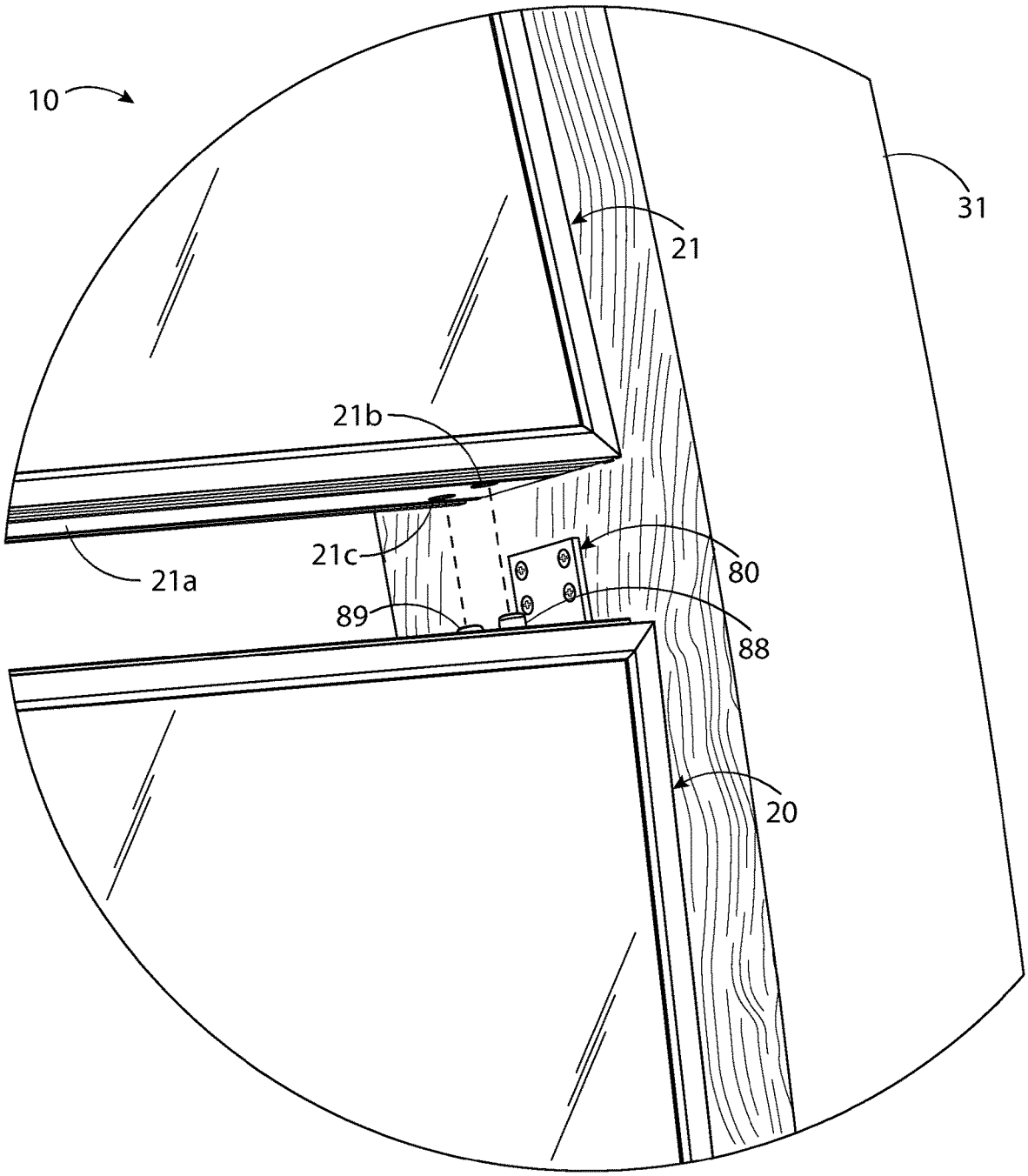
FIG. 17 illustrates an alternative view of FIG. 14 showing the apertures in the bottom frame member third modular infill panel units receiving the alignment pins from the bracket assembly attached to the top frame member of the second modular infill panel unit.

Referring to FIGS. 11 and 17, in step 103, the modular infill panel unit 21 is positioned over modular infill panel unit 20 so that apertures 21*b*, 21*c* in the bottom frame member 21*a* of modular infill panel unit 21 are aligned over the alignment pins 88, 89, respectively, of the first bracket assembly 80. Referring to FIG. 16, the alignment pins 91, 92 of the second angle bracket assembly 81 and corresponding apertures (hidden from view) of the bottom frame member 21*a* are also aligned. Referring to FIGS. 16 and 17, once positioned, the modular infill panel unit 21 is placed against modular infill panel unit 20 with the alignment pins 88, 89 (FIG. 17) and alignment pins 91, 92 (FIG. 16) positioned within the corresponding apertures in the bottom frame member 21*a*.

Figure 18:
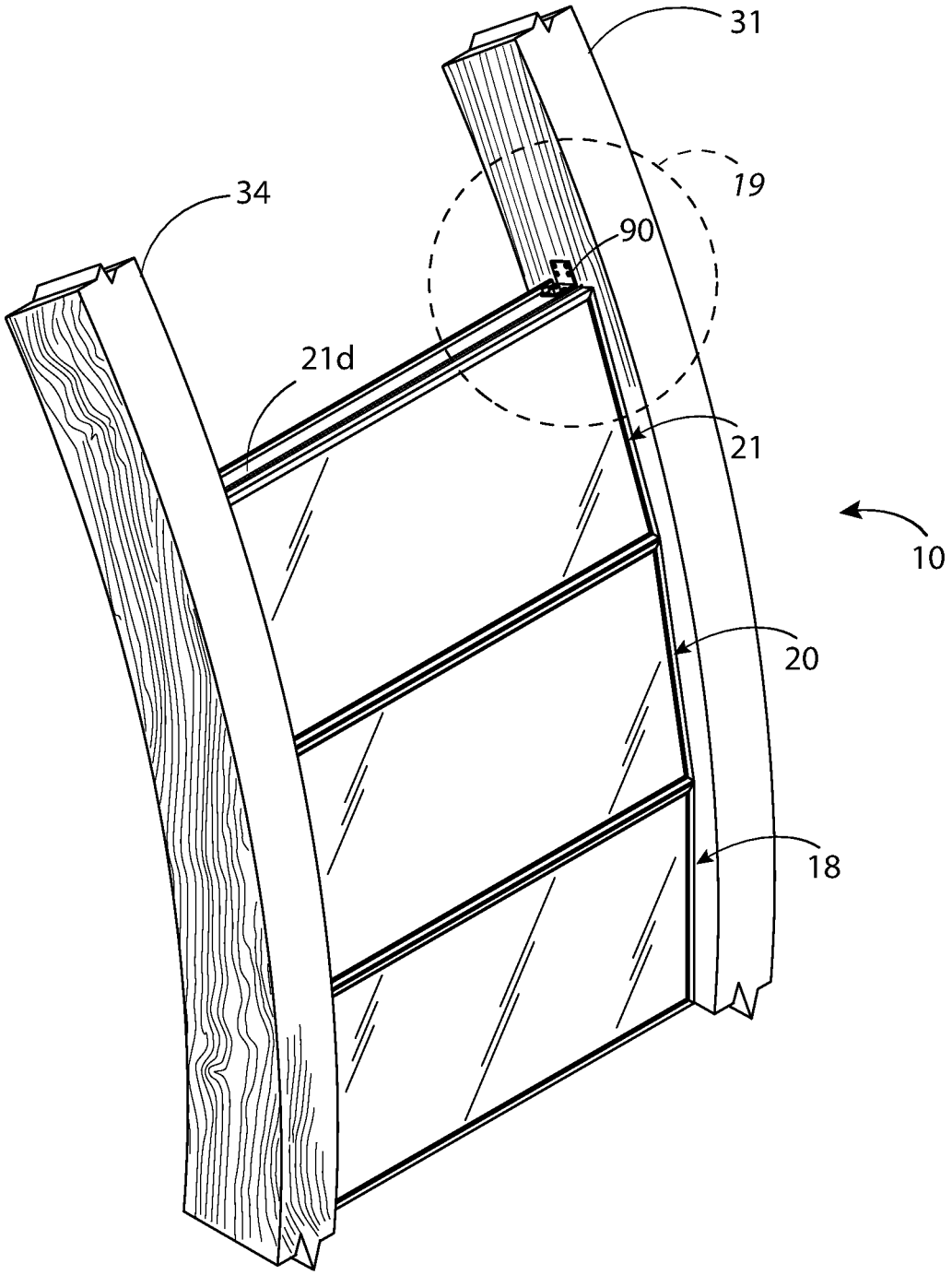
FIG. 18 shows, in left and front perspective view, the three modular infill panel units assembled and secured to adjacent columns.
Figure 19:
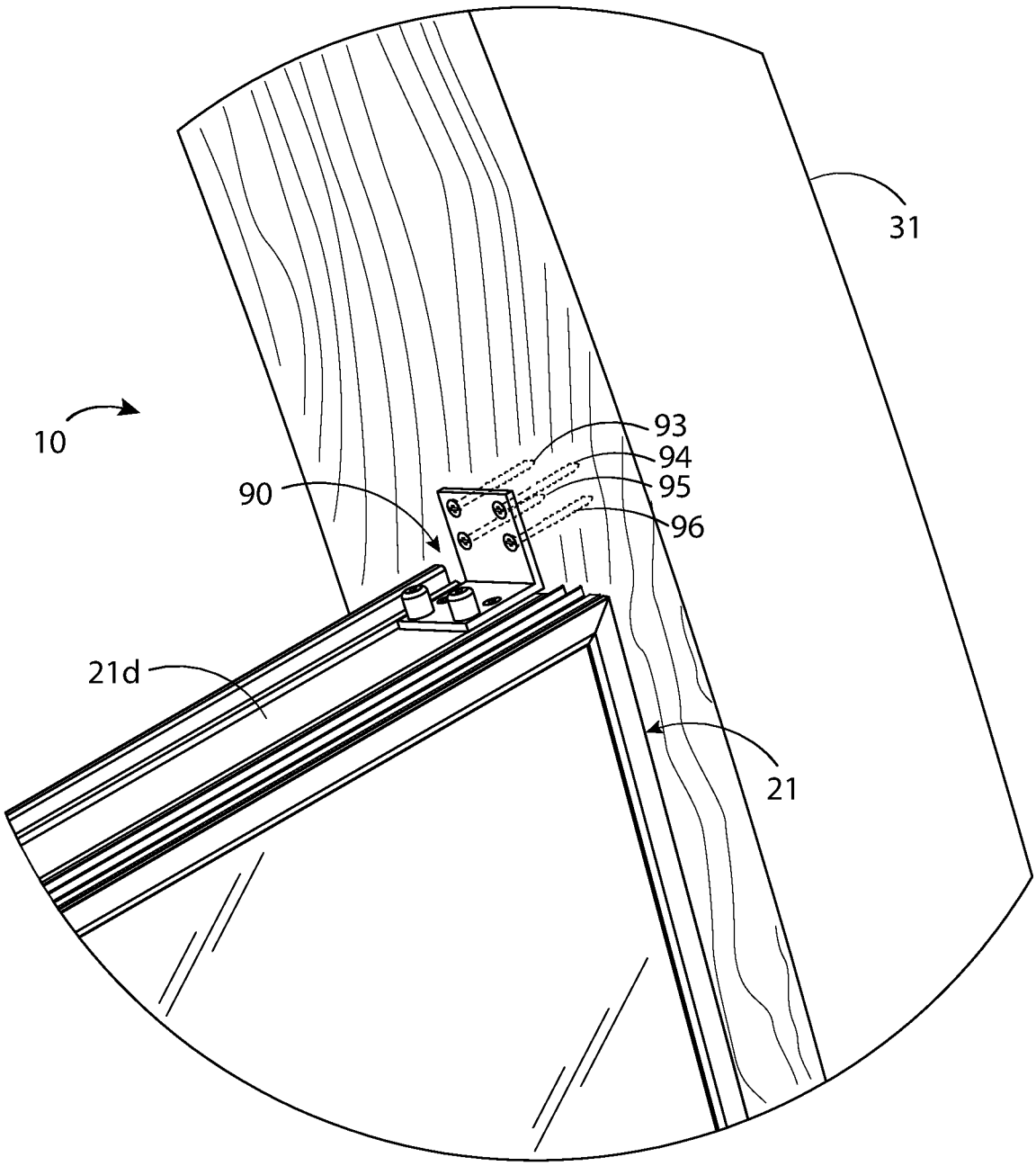
FIG. 19 illustrates a portion of FIG. 18, enlarged for magnification purposes, and showing attachment of the bracket assembly to the adjacent column.

Referring to FIGS. 18 and 19, and in step 104, with modular infill panel unit 21 positioned against modular infill panel unit 20 (FIG. 18), the bracket assembly 90 is secured to column 31. The corresponding bracket assembly positioned against the other end of the top frame member 21*d* (hidden from view), is secured to column 34 (FIG. 18). Referring to FIG. 19, the bracket assembly 90 can be secured to column 31 by threaded fasteners, such as threaded fasteners 93, 94, 95, 96. The sequence of steps 101-104 of FIG. 11 can be repeated for the height of the wall.

Figure 20:
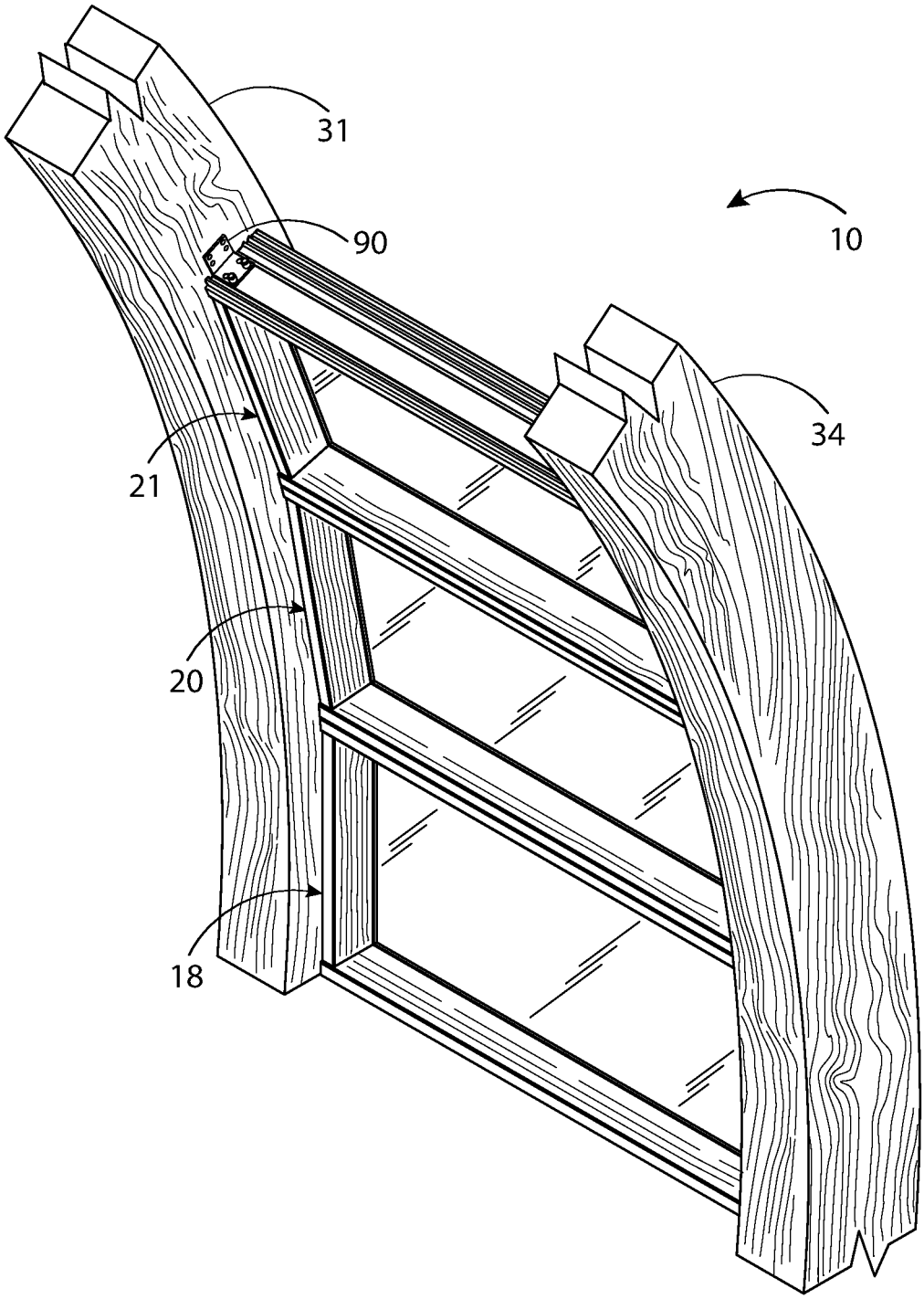
FIG. 20 illustrates an inside perspective view of the portion of FIG. 18.

One of the advantages of the modular infill panel system 10 developed by the inventors, is that the structural frames can be made out of a variety of materials including wood, wood composite, aluminum, or steel. Having the interior-facing structure made of wood can have an aesthetic advantage. FIG. 20 illustrates a portion of the modular infill panel system 10 of FIGS. 12, 13, 15, and 18 between columns 31, 34, as viewed from inside the building. In FIG. 20, the wood structural frame members of modular infill panel units 18, 20, 21 form an integrated appearance with the angle brackets hidden from view under the structural frame members. Bracket assembly 90 will be hidden from view once modular infill panel unit 22 (FIGS. 1-3) is secured over modular infill panel unit 21.

Figure 21:
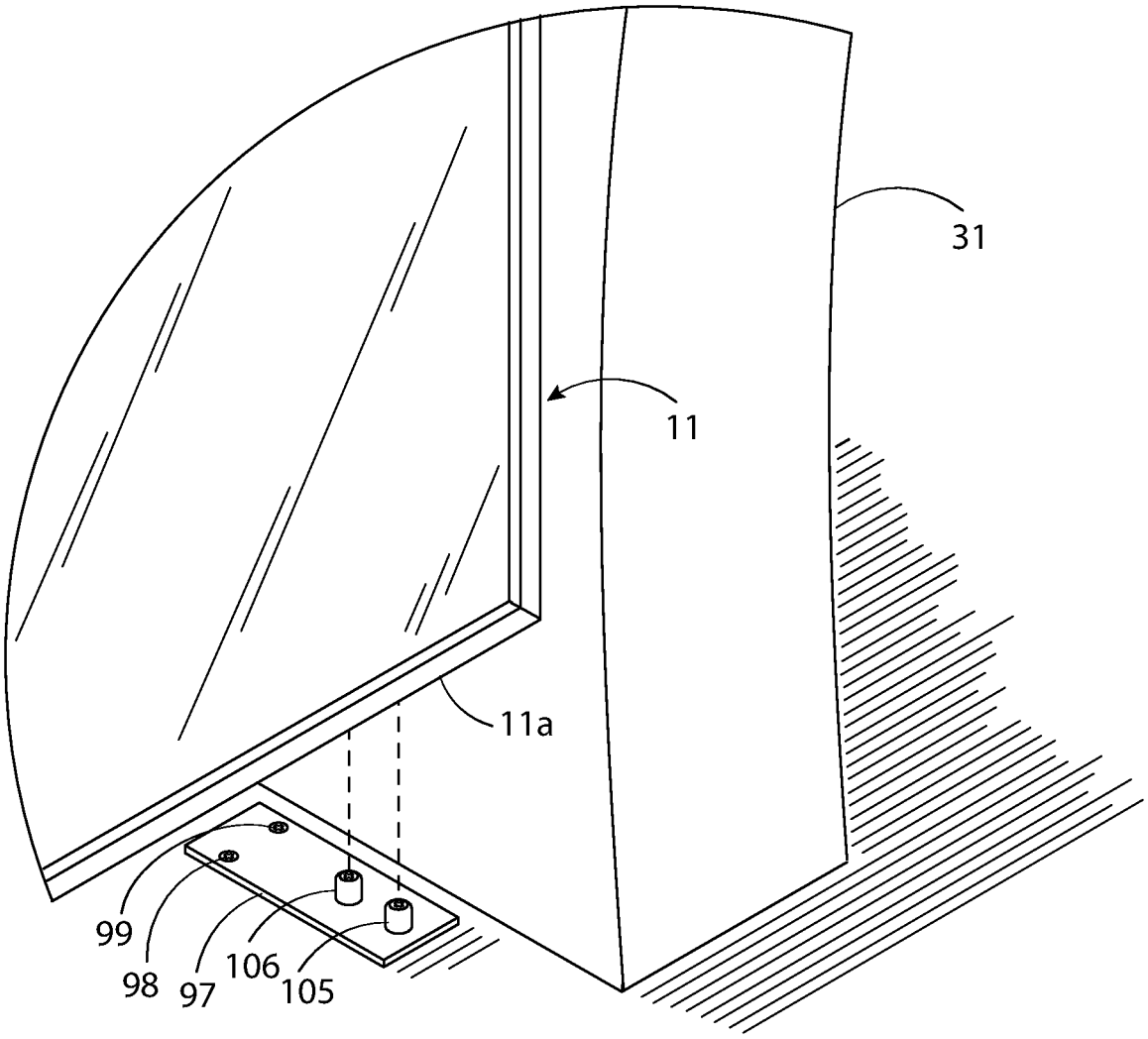
FIG. 21 illustrates a lower right-side portion of FIG. 2 in front and left perspective view, showing details of the connection of a modular infill panel unit to the floor.

While an angle bracket can be used when attaching the lowest modular infill panel unit to the floor or base of the building structure, it is not required. This is because the angle brackets, previously described, serve a dual purpose of aligning and holding vertically adjacent modular infill panel units and securing the modular infill panel units to the horizontally-adjacent vertical columns. On the floor or base of the building structure, only the alignment and holding function is required. Referring to FIG. 21, bracket 97 is illustrated as a flat bracket. This can be attached to the floor by threaded fasteners 98, 99. The alignment pins 105, 106 engage apertures, hidden from view, in the bottom frame member 11*a* of modular infill panel unit 11. Once the modular infill panel unit 11 engages the alignment pins 105, 106, the first bracket assembly and a second bracket assembly attached to the top frame member of the modular infill panel unit 11 can be attached to column 31 and column 34 (hidden in FIG. 21). This can be attached to column 31 and column 34 as described for modular infill panel unit 21 in FIGS. 18, 19 and step 104.

Figure 29:
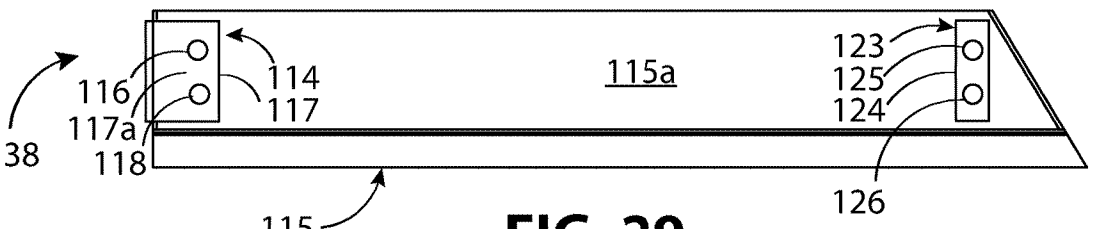
FIG. 29 illustrates a top view of the modular infill panel unit of FIG. 28.
Figure 30:
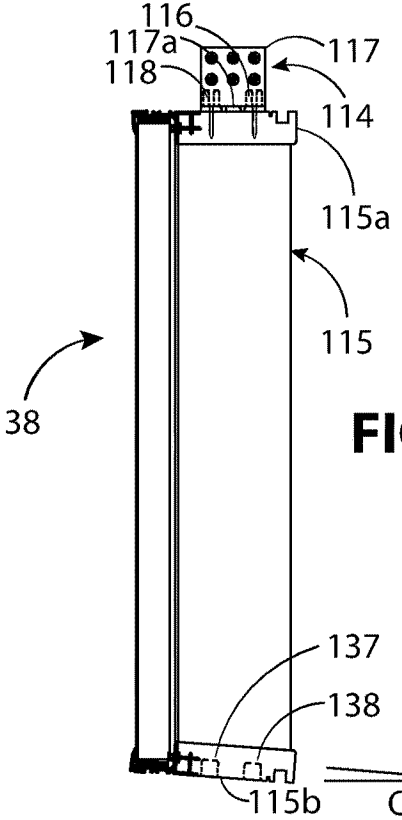
FIG. 30 illustrates a left-side elevation view of the modular infill panel unit of FIG. 28.
Figure 31:
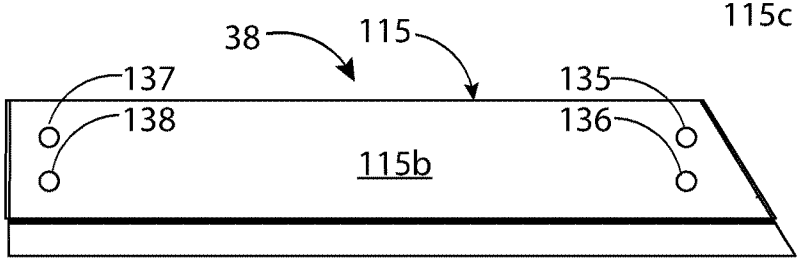
FIG. 31 illustrates a bottom view of a modular infill panel unit of FIG. 28.
Figure 32:
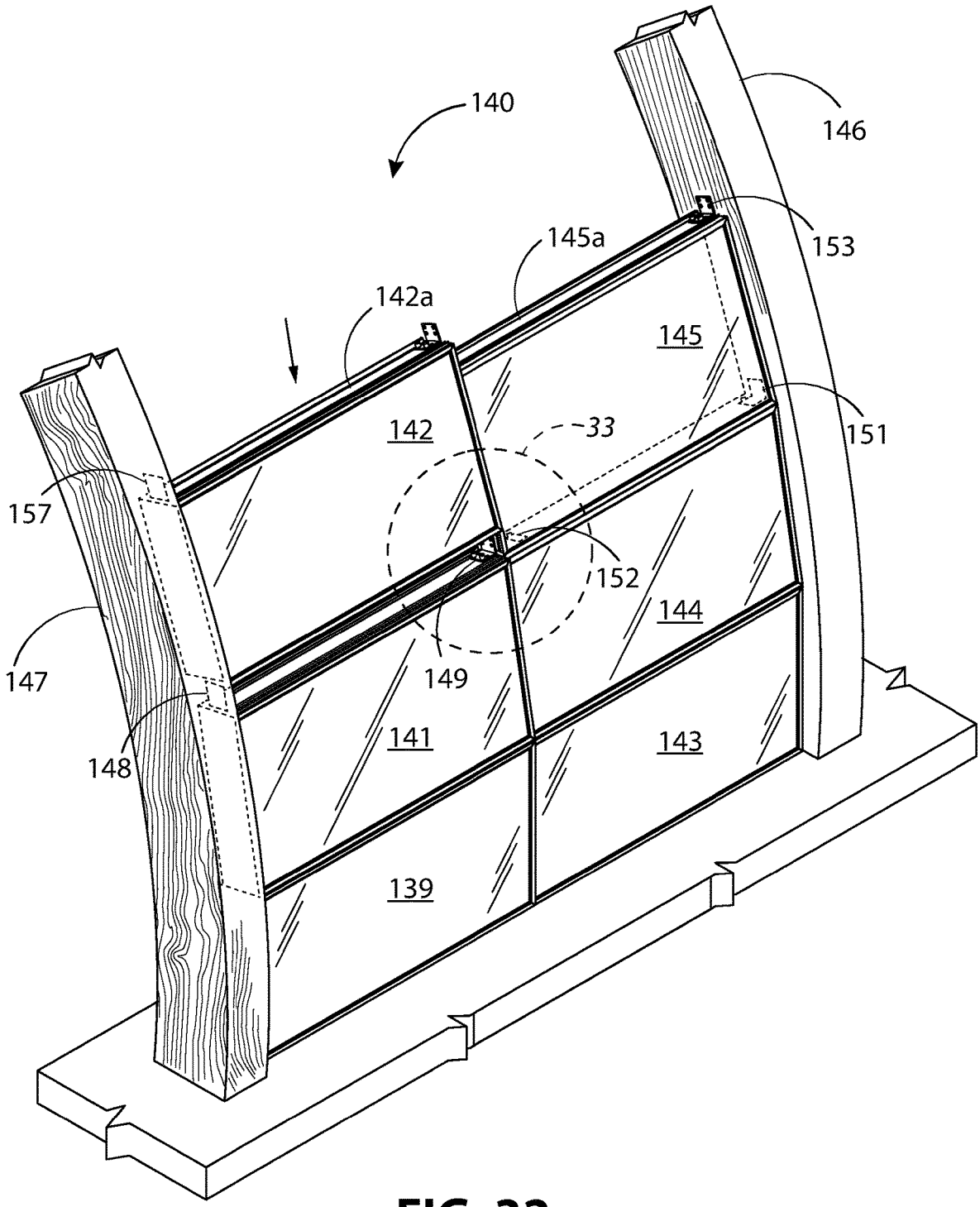
FIG. 32 illustrates a portion of an assembly demonstrating the modular infill system with two sets of panels placed side-by-side without a mullion or column between them.

FIGS. 22-33 illustrate modular infill panel units that are both vertically and horizontally stacked. FIGS. 22-31 illustrate a portion of the modular infill panel system 10 of FIGS. 1-3 where the modular infill panel units are vertically and horizontally stacked in such a way that creates a complex three-dimensional curve (i.e., curves in both the horizontal and vertical planes). FIGS. 31 and 32 illustrate modular infill panel units that are both vertically and horizontally stacked where the modular infill panel units are horizontally planar but curve in the vertical plane.

Figure 22:
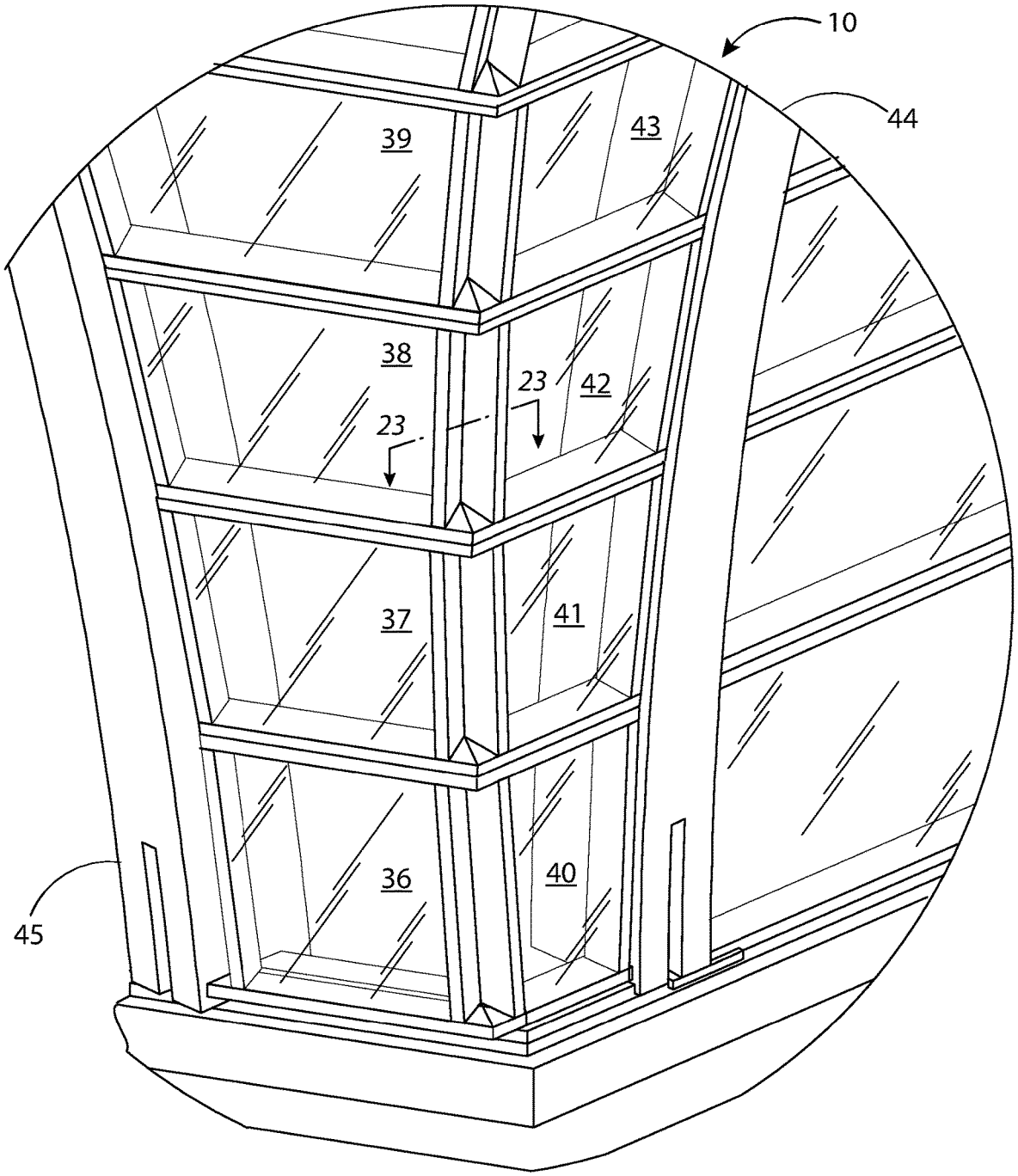
FIG. 22 illustrates a lower left-side portion of FIG. 1, illustrating a combination of modular infill panel units forming complex three-dimensional curves.
Figure 23:
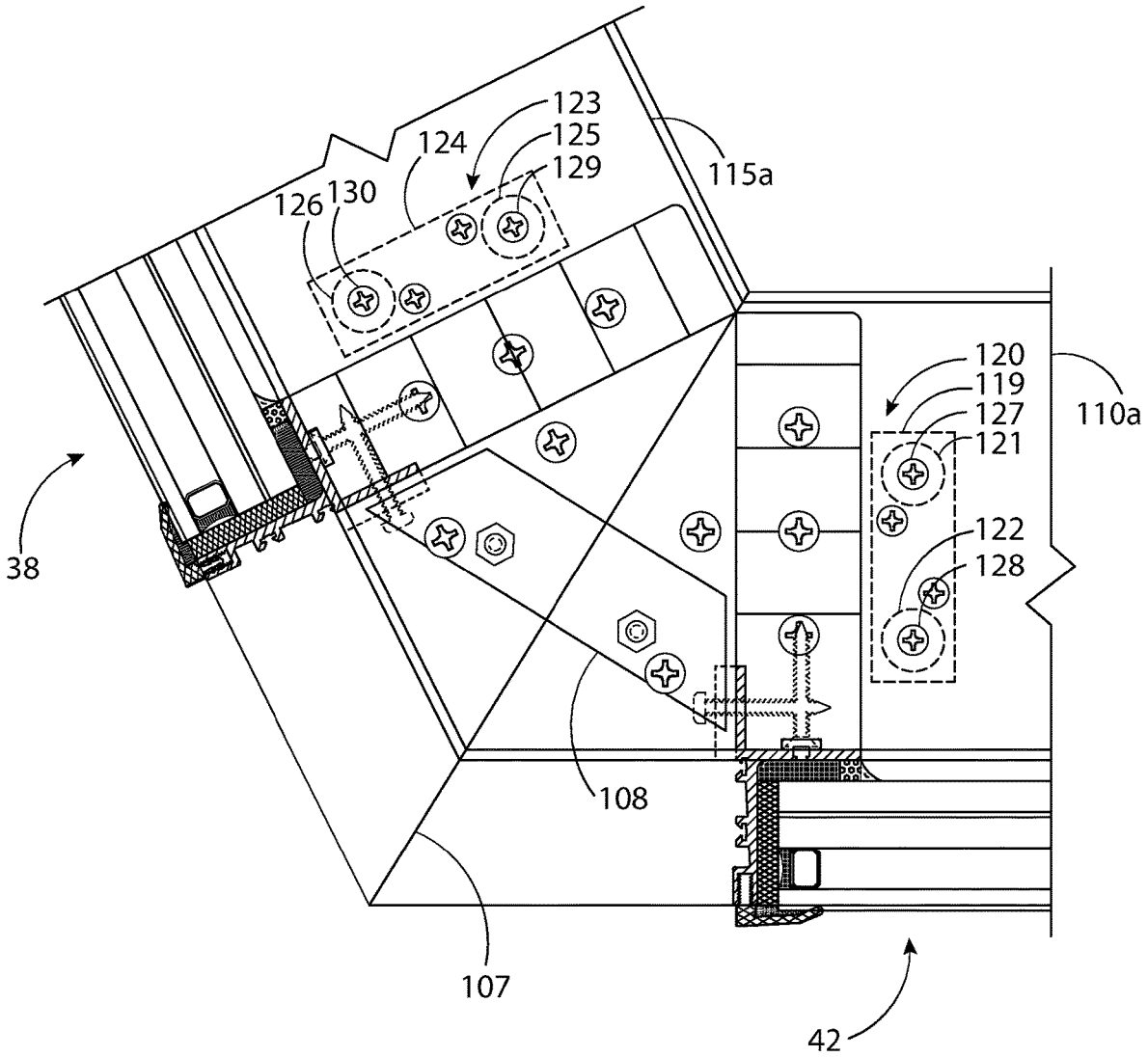
FIG. 23 illustrates a section view of a portion of FIG. 22 taken along section lines 23-23.

FIG. 22 illustrates an enlarged view of the lower left-side portion of FIG. 1 showing modular infill panel units 36, 37, 38, 39 on the left, and the modular infill panel units 40, 41, 42, 43 horizontally-adjacent on the right. FIG. 23 illustrates a section view of a portion of FIG. 22 taken along section lines 23-23. FIGS. 24-31 illustrate two adjacent modular infill panel units of FIG. 2: modular infill panel unit 42 in FIGS. 24-27 and the modular infill panel unit 38 in FIGS. 28-31. Referring to FIG. 22, each pair of horizontally-adjacent modular infill panel units, modular infill panel units 36, 40, modular infill panel units 37, 41, modular infill panel units 38, 42, and the modular infill panel units 39, 43 lie between columns 44, 45. The gravity forces in modular infill panel units 36, 37, 38, 39, 40, 41, 42, 43 are transferred downward through their structural frames while the out-of-plane forces are transferred to the columns 44, 45. This follows the same principles as previously described where the modular infill panel units 11, 12, 13, 15, 17, 18, 20, 21, 23, 26, 27, 30 of FIG. 1, transfer the gravity forces downward through modular infill panel unit's structural frames and the out-of-plane forces, such as forces from wind loads, are transferred to columns 31, 34.

Figure 25:
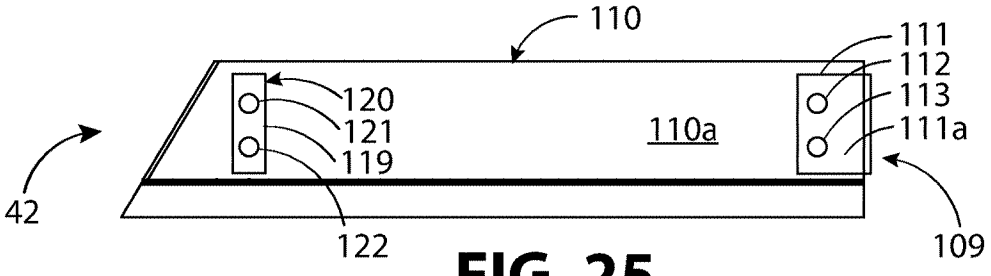
FIG. 25 illustrates a top plan view of the modular infill panel unit of FIG. 24.
Figure 24:
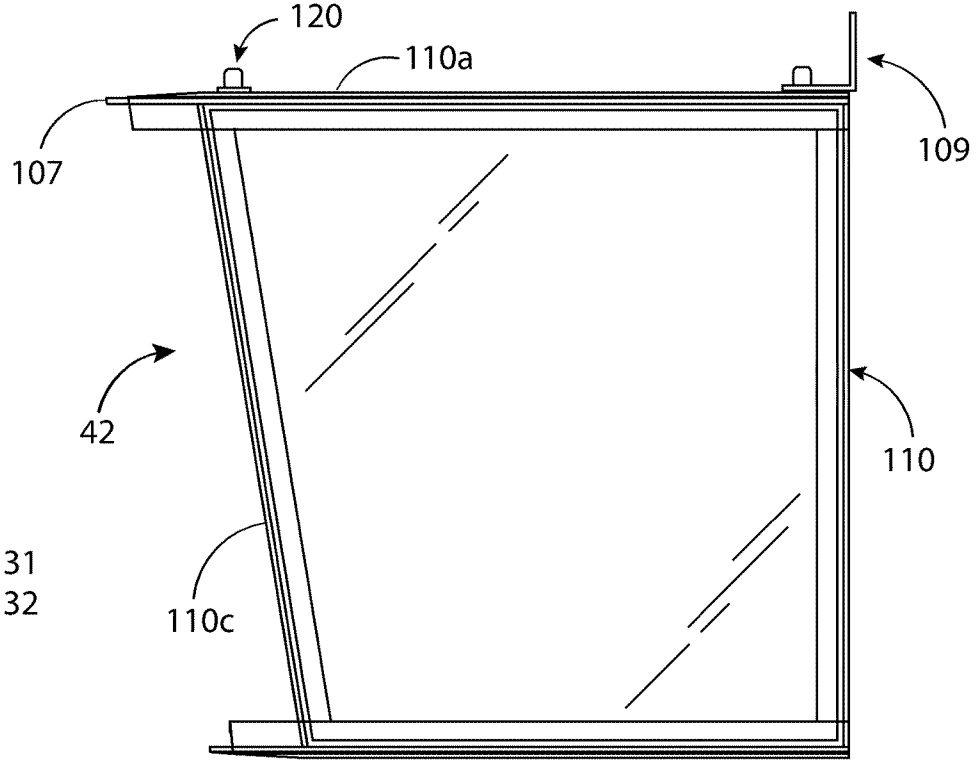
FIG. 24 illustrates a front elevation view of a modular infill panel unit of FIG. 22.
Figure 26:
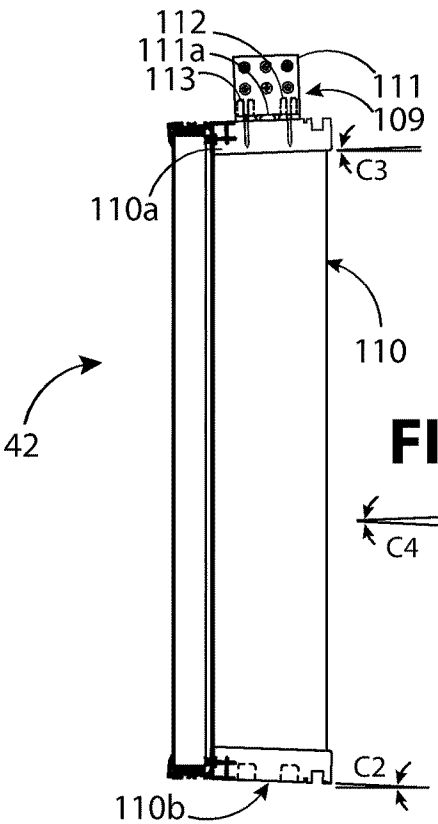
FIG. 26 illustrates a right-side elevation view of the modular infill panel unit of FIG. 24.
Figure 28:
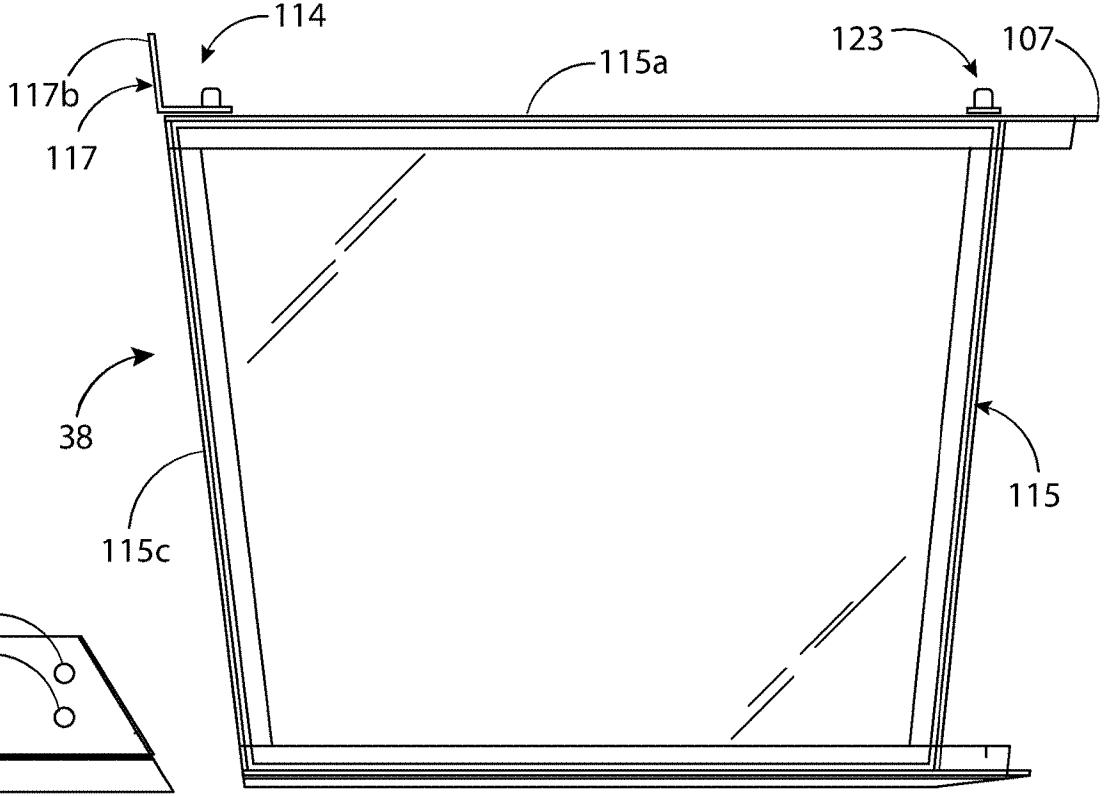
FIG. 28 illustrates a front elevation view of a modular infill panel unit of FIG. 22 that is horizontally-adjacent to the modular infill panel unit of FIG. 24.

Referring to FIG. 22 each pair of horizontally-adjacent glazing modules is held together at corresponding miter joints using corresponding splice blocks. For example, referring to FIGS. 22 and 23, modular infill panel units 38 and 42 are joined together at a miter joint 107 and by a splice plate 108. Referring to FIGS. 24 and 28, angle brackets with corresponding alignment pins are secured to the ends of the frame top members distal from the miter joint 107. In FIGS. 24-26, the bracket assembly 109 is secured to the top frame member 110*a* of the structural frame 110. Referring to FIGS. 25 and 26, the bracket assembly 109 includes an angle bracket 111, alignment pins 112, 113 projecting upward from the bottom leg 111*a* of the angle bracket 111. The angle bracket 111 can be secured to the top frame member 110*a* by threaded fasteners as previously described. Similarly, in FIGS. 28-30, the bracket assembly 114 is secured to the top frame member 115*a* of the structural frame 115. Referring to FIGS. 29 and 30, the bracket assembly 114 includes an angle bracket 117, alignment pins 116, 118 projecting upward from the bottom leg 117*a* of the angle bracket 117. The angle bracket 117 can be secured to the top frame member 115*a* by threaded fasteners as previously described. Referring to FIG. 28 the top leg 117*b* of the angle bracket 117 is co-planar with the vertical frame member 115*c*. This helps to assure that the vertical frame member 115*c* will align flush against column 45 and the vertical frame member of the modular infill panel unit 39 of FIG. 22, which is above modular infill panel unit 38, will be aligned flush against column 45.

Referring to FIGS. 23-25, bracket assembly 120 is secured against the top frame member 110*a* of modular infill panel unit 42. Referring to FIGS. 23 and 25, the bracket assembly 120 includes bracket 119 and alignment pins 121, 122. Bracket 119 being illustrated as a flat bracket. Referring to FIGS. 23, 28, and 29, bracket assembly 123 is secured against the top frame member 115*a* of modular infill panel unit 38. Referring to FIGS. 23 and 29, the bracket assembly 123 includes bracket 124 and alignment pins 125, 126. Bracket 124 being illustrated as a flat bracket. As previously described, the alignment pins 121, 122 and alignment pins 125, 126 project upward from brackets 119, 124, respectively. These alignment pins may be extruded, cast, or otherwise integrally formed with their respective brackets. Alternatively, they may be fastened to their respective brackets, for example, by threaded fasteners, welding, or adhesive. In FIG. 23, alignment pins 121, 122 are secured to bracket 119 and the top frame member 110*a* by threaded fasteners 127, 128, respectively. Similarly, alignment pins 125, 126 are secured to bracket 124 and the top frame member 115*a* by threaded fasteners 129, 130. Since there are no columns or mullions to attach between the horizontally-adjacent modular infill panel units, there is no need for the brackets proximate to the miter joint to be angle brackets.

Figure 27:
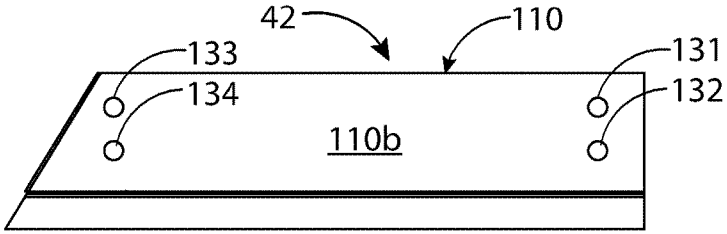
FIG. 27 illustrates bottom view of a modular infill panel unit of FIG. 24.

Referring to FIG. 27, the bottom frame member 110*b* of the structural frame 110 of modular infill panel unit 42 includes apertures 131, 132, 133, 134 for engaging corresponding alignment pins from modular infill panel unit 41. Similarly, in FIG. 31 the bottom frame member 115*b* of structural frame 115 includes apertures 135, 136, 137, 138 for engaging corresponding alignment pins from modular infill panel unit 37. The assembly sequence is similar as outlined in FIG. 11 for the single row of vertically stacked modular infill panel units. Referring to FIGS. 24 and 28, vertical frame members 110*c*, 115*c* facing each other align to create miter joint 107 of FIG. 23 and are joined together by the splice plate 108. The bracket assemblies 109, 114 on the top of modular infill panel units 42, 38, respectively, are fastened to their respective columns, the columns 44, 45, of FIG. 22. This, in combination with the alignment pins and secure connection from the bracket assemblies fastened to the modular infill panel units 37, 41, below modular infill panel units 38, 42, create a rigid connection where wind forces can be transferred to the columns.

Referring to FIG. 26, the bottom surface of the bottom frame member 110*b* makes an angle C2 with the floor (i.e., the horizontal). The top surface of the top frame member 110*a* makes an angle C3 with respect to the horizontal. The top surface of the top frame member 110*a* makes a widthwise oblique angle C4 with respect to the bottom surface of the bottom frame member 110*b*. Referring to FIG. 29, the top surface of the top frame member 115*a* makes a widthwise oblique angle C5 with respect to the bottom surface of the bottom frame member 115*b*. As illustrated in FIGS. 26 and 29, the top frame members 110*a*, 115*a* and the bottom frame members 110*b*, 115*b* can all be rectangular cuboids. The widthwise oblique angles between the top frame member 110*a* and the bottom frame members 110*b* or between the top frame member 115*a* and the bottom frame member 115*b* can be created by rotating one or more of the corresponding frame members along its lengthwise access. It can alternatively be created by widthwise mitering one or more of the corresponding frame members along their length.

Figure 33:
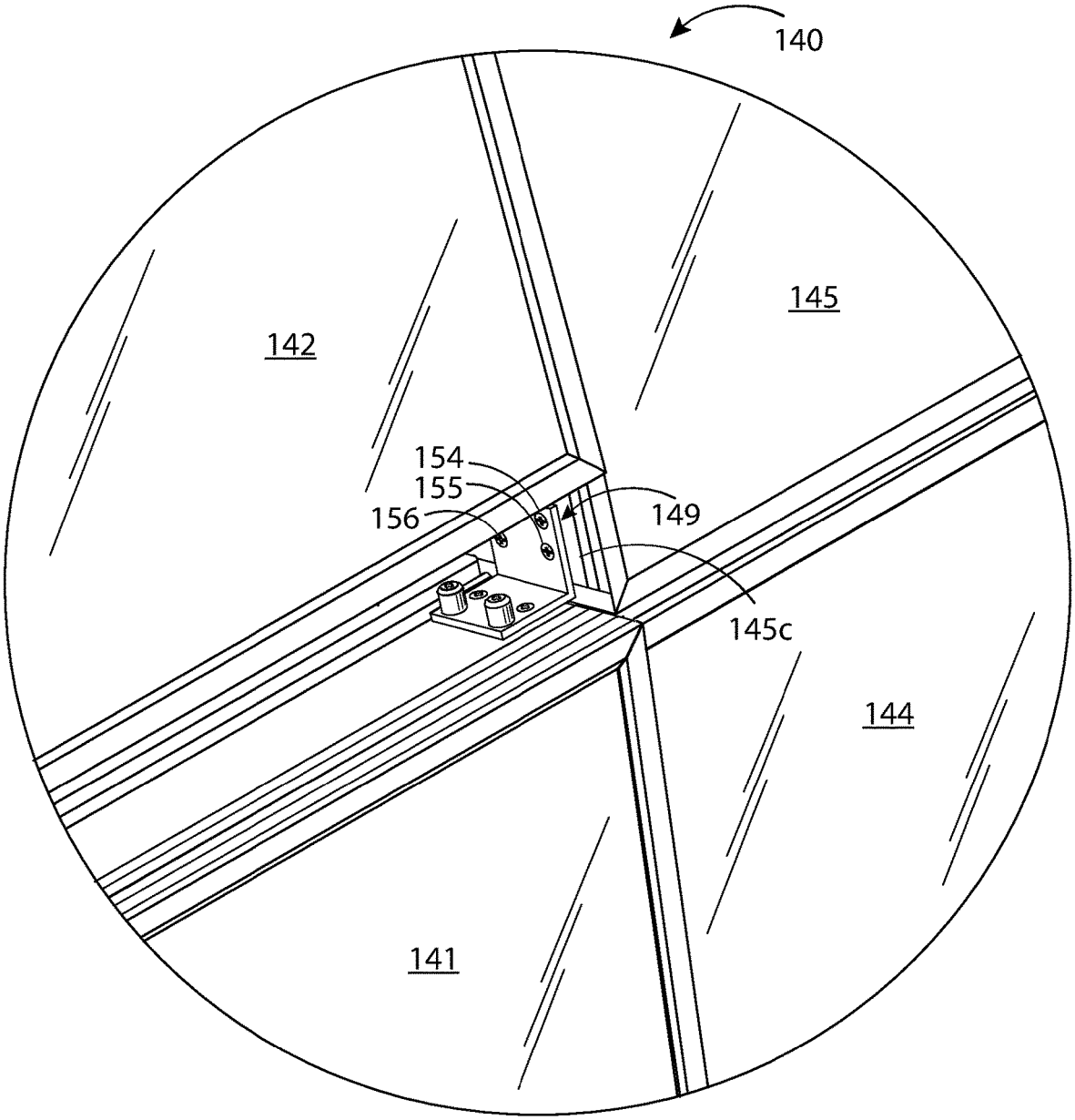
FIG. 33 illustrates a portion of FIG. 32, enlarged for magnification purposes showing the angle bracket attachment in more detail.

As shown in FIGS. 1-31, the modular infill panel units can be secured to horizontally-adjacent vertical structures. FIGS. 12, 13, 15, 18, and 20 showed connection to horizontally-adjacent vertical structures as columns, the columns 31, 34. FIGS. 22-31 demonstrated vertically stacked side-by-side pairs of modular infill panel units where the front infill panel surfaces of the side-by-side panels are at an oblique angle to each. FIGS. 32 and 33 illustrate a portion of a modular infill panel system 140 that illustrates an example of vertically stacked side-by-side pairs of modular infill panel units where front infill panel surfaces of the side-by-side panels are planar. Referring to FIG. 32, the modular infill panel units 139, 141, 142, 143, 144, 145 are positioned between columns 146, 147.

The modular infill panel units 139, 141, 142, 143, 144, 145, can include a similar structural combination as the modular infill panel unit 12 of FIGS. 4-9. The only difference being the number and position of the bracket assemblies and flat bracket assemblies. For each side-by-side pair of modular infill panel units, one of the modular infill panel units can include a pair of angle brackets, the other modular infill panel unit can include an angle and a flat bracket. The angle bracket can be located on the end of the top frame member facing the adjacent column and a flat bracket mounted proximate to the opposite end of the top frame member. As illustrated in FIG. 32, the modular infill panel units on the left, can include a pair of bracket assemblies that both include angle brackets. For example, modular infill panel unit 141 includes bracket assembly 148 secured to column 147 and the bracket assembly 149, both with angle brackets, secured to modular infill panel unit 145. Modular infill panel unit 144 includes bracket assembly 151 that includes an angle bracket, but does not need an angle bracket on its left-hand side, instead that bracket assembly can include a flat bracket. Note that the structural combination of modular infill panel units 139, 141, 142 can be identical to the structural combination of modular infill panel unit 12 of FIG. 7. The modular infill panel units 143, 144, 145 can also be identical except for the substitution of a flat bracket on the left-hand side. Modular infill panel units 139, 141, 142, on the left include two bracket assemblies with angle brackets. Modular infill panel units 143, 144, 145, on the right, have one bracket assembly with an angle bracket and one bracket assembly with a flat bracket. However, the left-right placement can be reversed. For example, modular infill panel units 139, 141, 142 could be mounted on the right and the modular infill panel units 143, 144, 145 mounted on the left.

The assembly sequence is like what was previously described. Typically, the modular infill panel units are installed pair-by-pair. Once the first pair is installed, the modular infill panel unit with only the column-side bracket assembly would be installed so that it may be secured at two points. It may be secured from the bracket assembly from the lower diagonally adjacent modular infill panel unit, and from its own bracket assembly to its adjacent column. For example, in FIG. 32, modular infill panel unit 145 would be aligned to the alignment pins of bracket assembly 151, and the alignment pins of the flat bracket assembly 152. Referring to FIG. 33, once seated, the bracket assembly 149 is secured to the vertical frame member 145*c*. This can be secured as previously described. For example, by threaded fasteners 154, 155, 156. Referring to FIG. 32, bracket assembly 153 mounted to the top frame member 145*a* of modular infill panel unit 145, secures modular infill panel unit 145 to column 146. Modular infill panel unit 142 is then aligned and seated to modular infill panel unit 141. Bracket assembly 157 secured to the top frame member 142*a* of modular infill panel unit 142 secures modular infill panel unit 142 to column 147.

One of the advantages of the modular infill panel system 10 of FIGS. 1-3, and the modular infill panel system 140 of FIG. 32, is that they share the same basic construction. This allows the two systems to be combined into a modular infill panel system with a uniform appearance that is independent of whether the surfaces are flat or curved. This is usually only achievable with space frames and other non-modular infill systems. This creates an important and distinct advantage for the present modular infill panel system.

Figure 34:
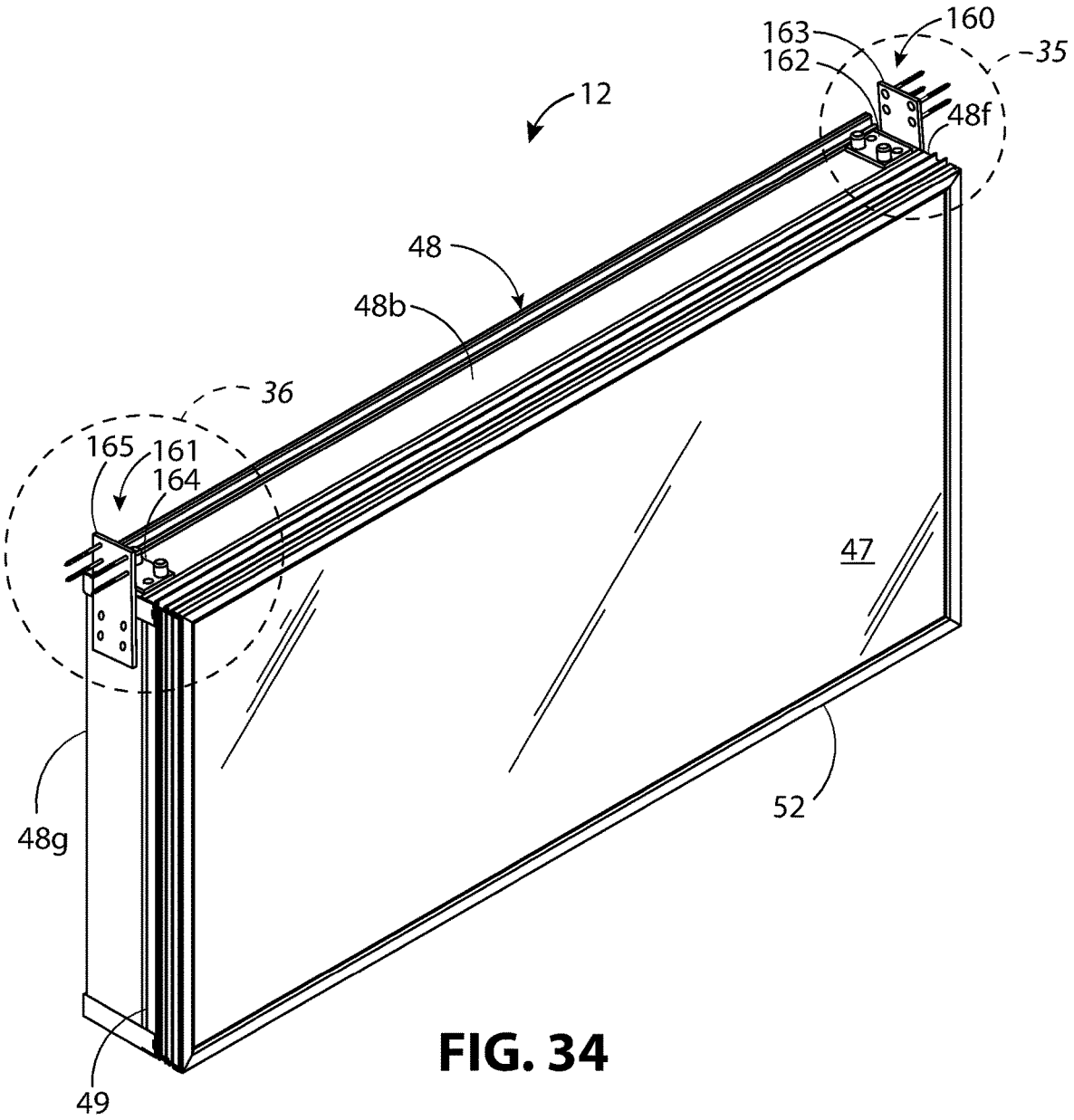
FIG. 34 illustrates the modular infill panel unit from FIG. 4, in front and top perspective view, with an alternative bracket assembly.
Figure 35:
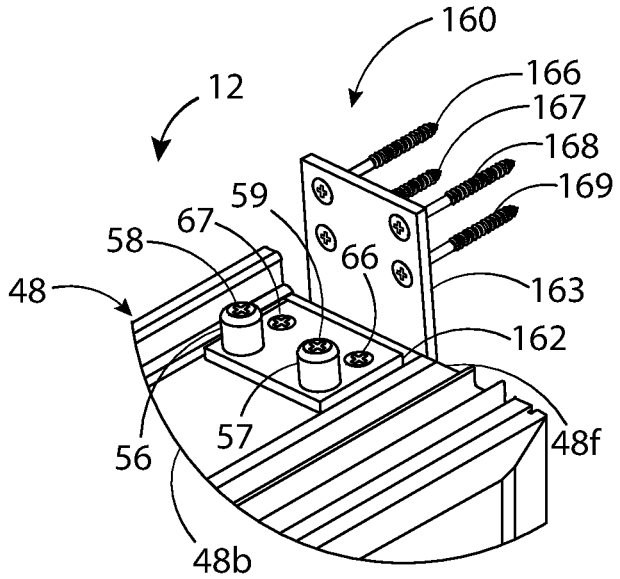
FIG. 35 illustrates a portion of FIG. 34, enlarged for magnification purposes showing the bracket assembly on the right side of FIG. 34 in more detail.
Figure 36:
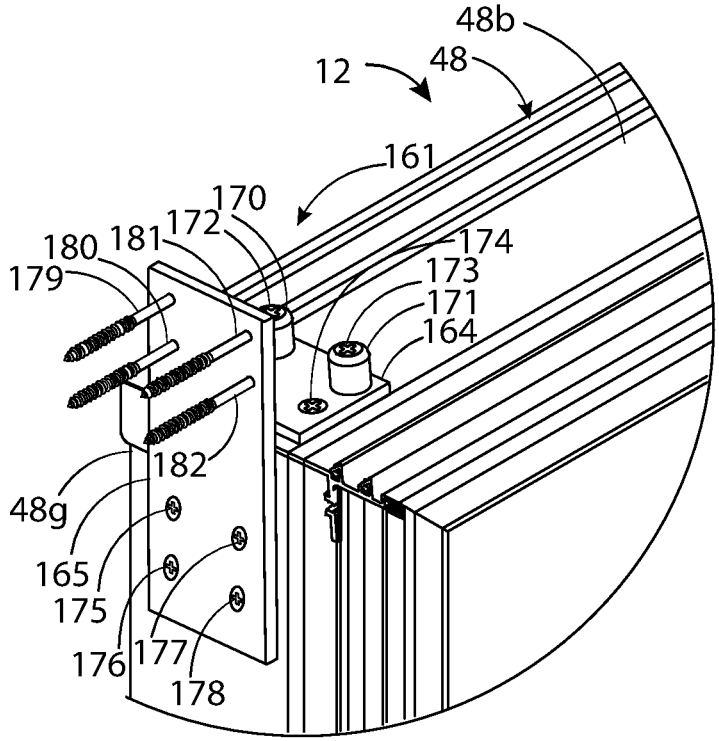
FIG. 36 illustrates a portion of FIG. 34, enlarged for magnification purposes showing the bracket assembly on the left side of FIG. 34 in more detail.

In FIGS. 4-9 the first bracket assembly 50 includes an angle bracket 55 (FIG. 5). FIGS. 34-36 illustrates the modular infill panel unit 12 from FIG. 4 using an alternative bracket assembly: the bracket assembly 160 (FIGS. 34 and 35) and the bracket assembly 161 (FIGS. 34 and 36). Except for the differences in the bracket assemblies, the modular infill panel unit 12 of FIGS. 4 and 34 can be the same. Both FIGS. 4 and 34 can include the infill panel 47, the infill panel frame 49, and the infill panel gasket 52. The infill panel 47 is again illustrated as a glazing panel, but can be other infill materials, as previously described. Referring to FIGS. 34 and 35, instead of angle brackets, the bracket assembly 160 includes the flat brackets 162,163. Flat bracket 162 is attached to the top frame member 48*b* of the structural frame 48. Flat bracket 163 is attached to side frame member 48*f* of the structural frame 48. Referring to FIGS. 34 and 36, the bracket assembly 161 includes flat brackets 164, 165. Flat bracket 164 is attached to the top frame member 48*b* of the structural frame 48. Flat bracket 165 is attached to side frame member 48*g* of the structural frame 48. Referring to FIG. 35, alignment pins 56, 57 project upward from the flat bracket 162. Alignment pins 56, 57 are oriented across flat bracket 162 in such a way that orients them widthwise across the top frame member 48*b*. The alignment pins 56, 57 can be secured to the flat bracket 162 by threaded fasteners 58, 59. They can be attached to the flat bracket 162 by welding, adhesive, riveting, or other rigid fastening mechanisms. Alternatively, they can be extruded, cast, or otherwise integrally formed with the flat bracket 162. The flat bracket 162 is shown fastened to the top frame member 48*b* by threaded fasteners 66, 67 but can be attached by other permanent securing structures, known to one skilled in the art, that are capable of sustaining the forces of gravity and wind that the modular infill panel unit 12 is subjected to. The flat bracket 163 is secured to the side frame member 48*f* by threaded fasteners that are hidden from view. Threaded fasteners 166, 167, 168, 169 attach the flat bracket 163 to column 31 of FIGS. 1-3, other horizontally-adjacent vertical building structure, or horizontally-adjacent modular infill panel unit.

Referring to FIG. 36, alignment pins 170, 171 project upward from the flat bracket 164. They are also oriented across flat bracket 164 in such a way that orients them widthwise across the top frame member 48*b*. The alignment pins 170, 171 can be secured to the flat bracket 164 by threaded fasteners 172, 173 or otherwise attached or integrally formed with the flat bracket 164 as previously discussed. The flat bracket 164 can be attached to the top frame member 48*b* by threaded fasteners, such as threaded fastener 174 in combination with threaded fasteners 172, 173 or by other fastening methods as previously discussed. The flat bracket 165 can be secured to the side frame member 48*g* by threaded fasteners such as threaded fasteners 175, 176, 177, 178. Threaded fasteners, such as threaded fasteners 179, 180, 181, 182 can attach the flat bracket 165 to column 34 of FIGS. 1-3, other horizontally-adjacent vertical building structure, or horizontally-adjacent modular infill panel unit.

Figure 37:
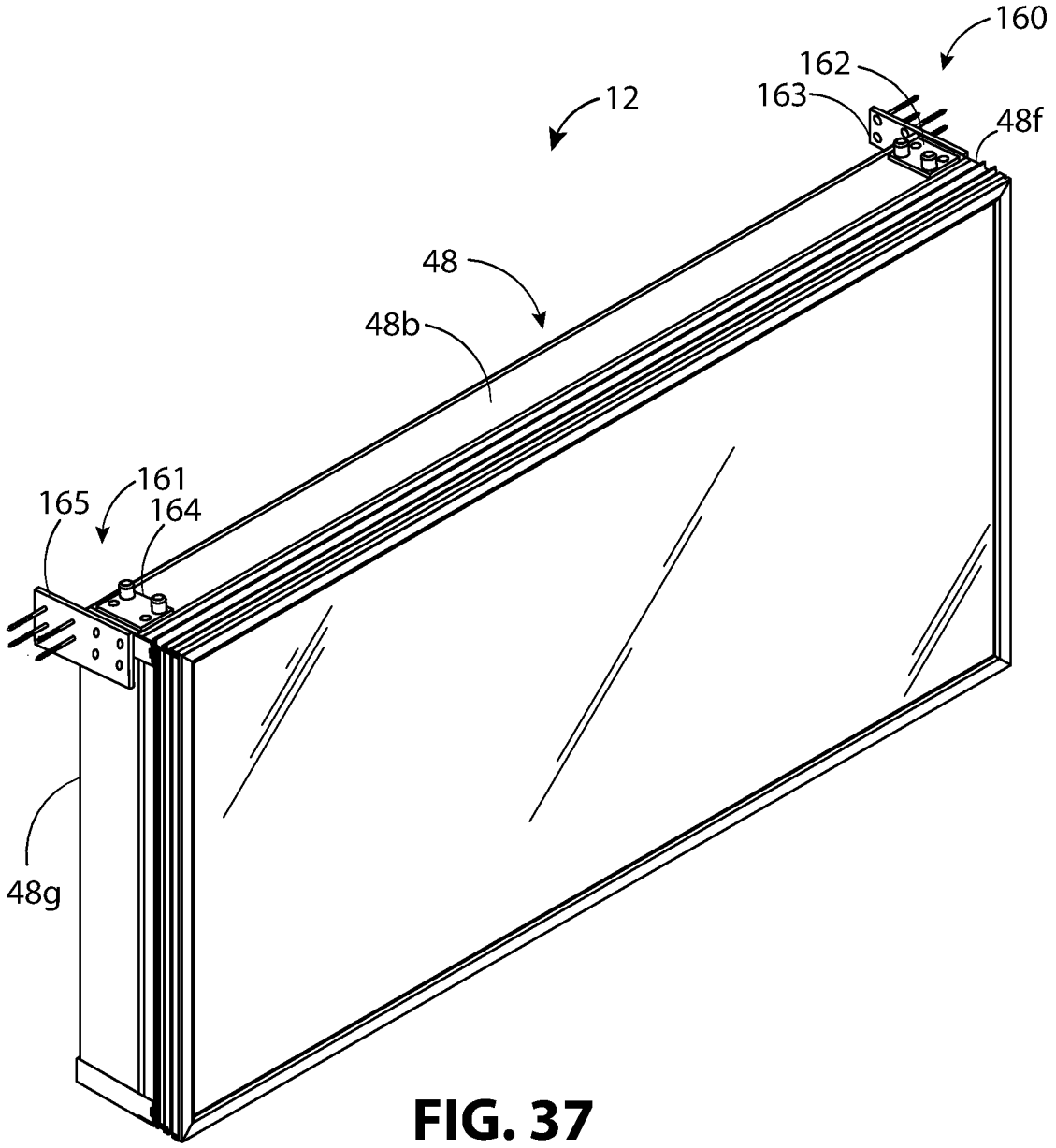
FIG. 37 illustrates the modular infill panel unit from FIG. 34, in front and top perspective view, with the second flat bracket rotated 90° rearward.

Referring to FIG. 37, the flat brackets 163, 165 of the bracket assembly 160 and bracket assembly 161, respectively, can be rotated 90° rearward. The flat brackets 163, 165 can be fastened to columns 31, 34, respectively, as described for FIGS. 34-36. except they are attached to a portion of the columns 31, 34 of FIGS. 1-3 that are interior to the modular infill panel unit 12. Other than the rotation of the flat bracket 163, 164, the modular infill panel unit 12 of FIG. 37, can be the same as the modular infill panel unit 12 of FIG. 34, including the flat brackets 162, 164 secured to the top frame member 48*b* of the structural frame 48, as previously described. In addition, flat brackets 163, 165 can be secured to the side frame member 48*f*, 48*g*, respectively, as previously described except that they are rotated 90° rearward.

Figure 38:
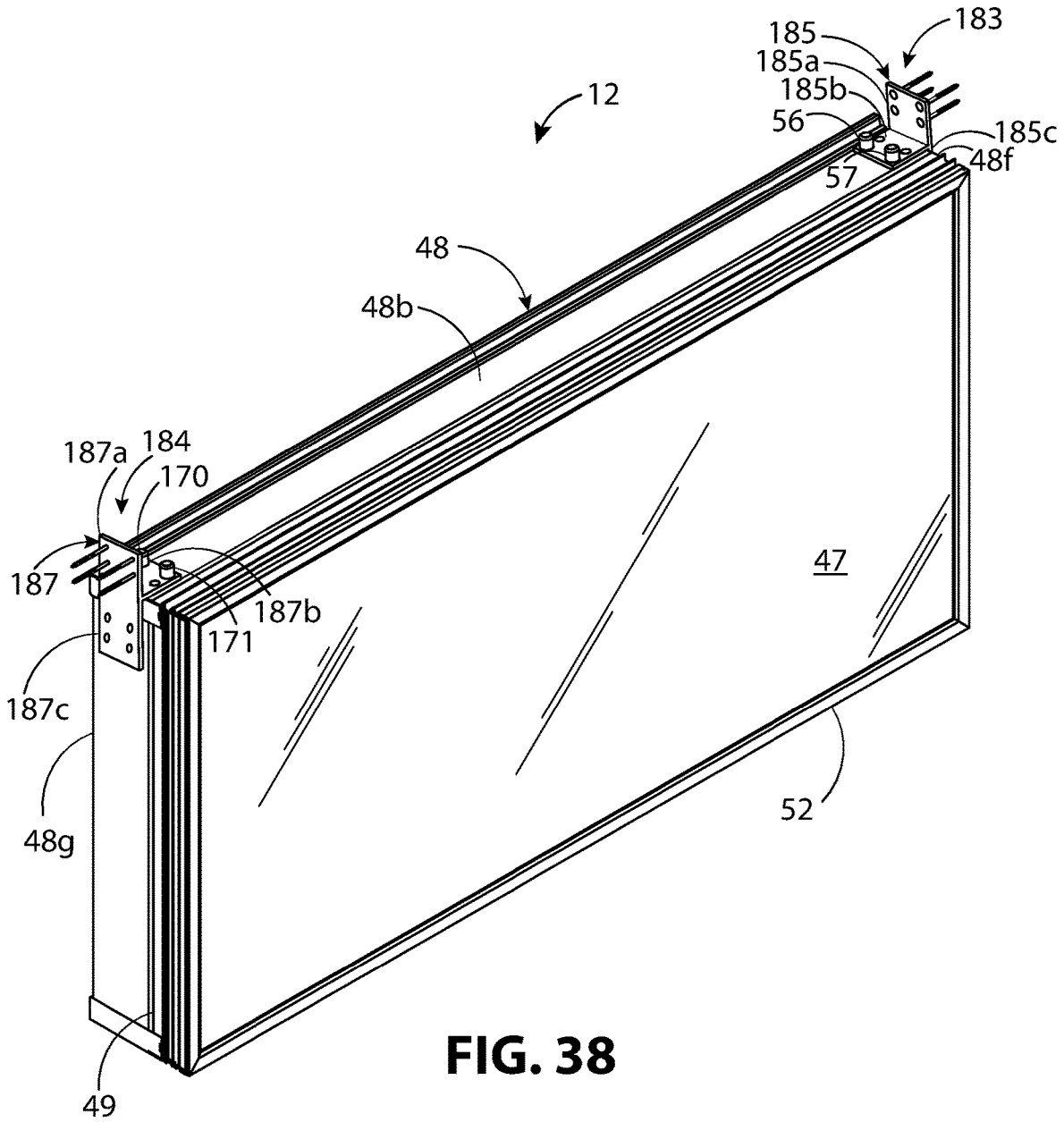
FIG. 38 illustrates the modular infill panel unit from FIG. 4, in front and top perspective view, with a second alternative bracket assembly that includes a t-bracket.

FIG. 38 illustrates the modular infill panel unit 12 from FIG. 4 using bracket assemblies 183, 184 instead of the first bracket assembly 50 and the second bracket assembly 51. Except for bracket assemblies 183, 184, the modular infill panel unit 12 of FIG. 38 can be the same as the modular infill panel unit 12 of FIG. 4. For example, the modular infill panel units 12 of FIGS. 4 and 38 can include an infill panel 47, infill panel frame 49, and infill panel gasket 52. Referring to FIG. 38, the bracket assemblies 183, 184 includes t-brackets 185, 187. The center bracket portions 185*b*, 187*b* of the t-brackets 185, 187, respectively, can be secured to top frame member 48*b* of the structural frame 48. The center bracket portions 185*b*, 187*b* can be secured to the top frame member as previously described for flat brackets 162, 164 of FIG. 34. The alignment pins 56, 57 project upward from the center bracket portion 185*b*. The alignment pins 170, 171 project upward from the center bracket portion 187*b*. The alignment pins 56, 57 and alignment pins 170, 171 can be secured to or alternatively be integrally formed with their respective center bracket portions, the center bracket portions 185*b*, 187*b* as previously described.

The upper bracket portion 185*a* of the t-bracket 185 projects upward from the side frame member 48*f*. The lower bracket portion 185*c* of the t-bracket 185 is attached to side frame member 48*f* of the structural frame 48 by threaded fasteners or the like as previously described for flat bracket 163 of FIG. 34. Upper bracket portion 185*a* can be fastened by threaded fasteners or the like to a horizontally-adjacent vertical building frame member, column, or horizontally-adjacent modular infill panel unit. For example, the upper bracket portion can be attached to column 31 of FIGS. 1-3. The upper bracket portion 187*a* of the t-bracket 187 projects upward from the side frame member 48*g*. The lower bracket portion 187*c* of the t-bracket 187 is attached to side frame member 48*g* of the structural frame 48 by threaded fasteners or the like as previously described. Upper bracket portion 187*a* can be fastened by threaded fasteners or the like to a horizontally-adjacent vertical building frame member, column, or horizontally-adjacent modular infill panel unit. For example, the upper bracket portion can be attached to column 34 of FIGS. 1-3. The reader should note, that after reading this and the preceding paragraph, they can readily substitute the t-bracket 187 whenever an angle bracket is called for throughout the examples of this disclosure.

A modular infill panel system has been described. It is not the intent of this disclosure to limit the claimed invention to the examples and variations described in the specification. Those skilled in the art will recognize that variations will occur when embodying the claimed invention in specific implementations and environments. For example, while the structural frames 48, 110, 115 of FIGS. 4-9, FIGS. 24-27, and FIGS. 28-31, respectively, are illustrated as wood or composite frames with corresponding infill panel frames mounted to their front surfaces, the structural frames 48, 110, 115 can be made from other materials. For example, they can be made from fiberglass or aluminum. In the case of fiberglass or aluminum, instead of the infill panels being mounted to an infill panel frame in front of the structural frame, the infill panels can be mounted directly within the structural frame. In the case of an aluminum structural frame, the infill panel can be a thermally broken glazed panel, in the form of an IGU, with the airspace between the glass panels mounted in the thermal break of the frame. The bracket assemblies can be structured and positioned so that the two or more alignment pins extending from the angle bracket of the bracket assembly engage the two or more apertures, and seat the vertically adjacent modular infill panel unit, as previous discussed. In addition, the side frame members of the two modular infill panel units are planarly aligned against a horizontally-adjacent vertical structure such as column 31 of FIGS. 1-3, and the modular infill panel unit is secured to the horizontally-adjacent vertical structure.

The infill panels in FIGS. 1-38 are illustrated as glazed panels. However, these can be made of other materials. For example, the infill panels can be aluminum panels, composite panels, foam-filled or plastic-filled aluminum composite panels, stone panels, brick veneer panels, terracotta panels, or other infill panel materials.

Columns 31, 34 are illustrated in FIG. 2 as having a serpentine curve. One of the advantages of the described modular infill panel system is that a wide range of curves can be implemented. For example, in FIG. 2, the curve shape can be made simpler or more complex by changing the angle of the bottom frame members and/or top frame members of one or more of the modular infill panel units. This in turn can change one or more of angles A1, A2, A3, A4, A5, A6, A7, A8, A9, A10, A11 and angles B1, B2, B3, B4, B5, B6, B7, B8, B9, B10, B11, B12.

Similarly, a wide range of three-dimensional shapes can be implemented by changing the widthwise-oblique angle between the top frame member and bottom frame member of the modular infill panel units, changing the shape of the infill panel frames and their corresponding infill panels, and by changing the angle of the miter joint and/or the shape of the structural frame of horizontally-adjacent modular infill panel units.

It is possible to implement certain features described in separate examples in combination within a single example. Similarly, it is possible to implement certain features described in single examples either separately or in combination in multiple examples. For example, modular infill panel units 11, 12, 13, 15, 17, 18, 29, 21, 23, 26, 27, 30 of FIGS. 1-3, and exemplified by modular infill panel unit 12 of FIGS. 4-9 can be combined in various combinations with horizontally-adjacent modular infill panel units such as those exemplified in FIG. 22 or in FIG. 32.

Any appended claims are not to be interpreted as including means-plus-function limitations, unless a claim explicitly evokes the means-plus-function clause of 35 USC § 112(f) by using the phrase "means for" followed by a verb in gerund form.

"Optional" or "optionally" is used throughout this disclosure to describe features or structures that are optional. Not using the word optional or optionally to describe a feature or structure does not imply that the feature or structure is essential, necessary, or not optional. The word "or," as used in this disclosure, is to be interpreted to mean an "inclusive or" unless modified by a word or phrase that indicates it is an "exclusive or." The phrase "A or B" can mean: A alone, B alone, A in combination with B. For clarity, the word "or" may be used interchangeably with "and/or." An example of a word or phrase that transforms "or" into is an "inclusive or" is "either." For example, "either A or B" means A alone, B alone, but not A in combination with B.

While the examples and variations are helpful to those skilled in the art in understanding the claimed invention, it should be understood that, the scope of the claimed invention is defined solely by the following claims and their equivalents.

What is claimed is:

1. A modular infill panel system for attachment to a building structure, comprising:

a first modular infill panel unit including a first structural frame and a second modular infill panel unit including a second structural frame;

a column attached to the building structure, the column is horizontally adjacent to the first structural frame, the second structural frame, and is curved;

a first bracket assembly including a bracket and two or more alignment pins projecting upward from a top frame member of the first structural frame and aligned widthwise across the top frame member;

two or more apertures positioned widthwise across a bottom frame member of the second structural frame; and the bracket is secured to the first structural frame, the bracket and the two or more alignment pins are positioned and shaped so the two or more alignment pins engage the two or more apertures, the two or more alignment pins seat the bottom frame member over the top frame member, the bracket planarly aligns adjacent sides of the first structural frame and the second structural frame against the column with the first modular infill panel unit securable to the column through the bracket.

2. The modular infill panel system of claim 1, wherein:

the bracket is an angle bracket, the angle bracket includes a lower leg secured to the top frame member and an upper leg projecting upward from the lower leg and securable to the column, and the two or more alignment pins project upward from the lower leg.

3. The modular infill panel system of claim 1, wherein:

the first modular infill panel unit includes a first infill panel frame secured to a first front surface of the first structural frame and a first infill panel secured to the first infill panel frame; and the second modular infill panel unit includes a second infill panel frame secured to the second structural frame and a second infill panel secured to the second infill panel frame.

4. The modular infill panel system of claim 3, wherein the first infill panel and the second infill panel are glazed panels.

5. The modular infill panel system of claim 3, wherein:

at least one of the bottom frame member or the top frame member is lengthwise mitered causing front faces of the first modular infill panel unit and the second modular infill panel unit to form an oblique angle.

6. The modular infill panel system of claim 3, wherein:

the bottom frame member and the top frame member are widthwise-oblique angle with respect to each other causing front faces of the first modular infill panel unit and the second modular infill panel unit to form an oblique angle.

7. The modular infill panel system of claim 1, wherein:

the first modular infill panel unit includes a first infill panel secured to the first structural frame; and the second modular infill panel unit includes a second infill panel secured to the second structural frame.

8. The modular infill panel system of claim 7, wherein:

at least one of the bottom frame member or the top frame member is lengthwise mitered causing front faces of the first modular infill panel unit and the second modular infill panel unit to form an oblique angle.

9. The modular infill panel system of claim 7, wherein:

the bottom frame member and the top frame member are widthwise-oblique angle with respect to each other causing front faces of the first modular infill panel unit and the second modular infill panel unit to form an oblique angle.

10. The modular infill panel system of claim 1, wherein:

the bottom frame member and the top frame member are widthwise-oblique angle with respect to each other causing front faces of the first modular infill panel unit and the second modular infill panel unit to form an oblique angle.

11. A modular infill panel system for attachment to a horizontally-adjacent vertical structure, comprising:

a first modular infill panel unit includes a first structural frame, a first infill panel frame separate from and secured to the first structural frame, and a first infill panel secured to the first infill panel frame;

a second modular infill panel unit includes a second structural frame, a second infill panel frame separate from and secured to the second structural frame, and a second infill panel secured to the second infill panel frame;

a first bracket assembly including a bracket and two or more alignment pins projecting upward from a top frame member of the first structural frame and aligned widthwise across the top frame member;

two or more apertures positioned widthwise across a bottom frame member of the second structural frame; and the bracket is secured to the first structural frame, the bracket and the two or more alignment pins are positioned and shaped so the two or more alignment pins engage the two or more apertures, the two or more alignment pins seat the bottom frame member over the top frame member, the bracket planarly aligns adjacent sides of the first structural frame and the second structural frame against the horizontally-adjacent vertical structure with the first modular infill panel unit securable to the horizontally-adjacent vertical structure through the bracket.

12. The modular infill panel system of claim 11, wherein the first infill panel and the second infill panel are glazed panels.

13. The modular infill panel system of claim 11, wherein:

the bottom frame member and the top frame member are widthwise-oblique angle with respect to each other causing front faces of the first modular infill panel unit and the second modular infill panel unit to form an oblique angle.

14. A modular infill panel system for attachment to a horizontally-adjacent vertical structure, comprising:

a first modular infill panel unit including a first structural frame, a first infill panel frame secured to a first front surface of the first structural frame, and a first infill panel secured to the first infill panel frame;

a second modular infill panel unit including a second structural frame a second infill panel frame secured to a second front surface of the second structural frame, and a second infill panel secured to the second infill panel frame;

a first bracket assembly including a bracket and two or more alignment pins projecting upward from a top frame member of the first structural frame and aligned widthwise across the top frame member;

two or more apertures positioned widthwise across a bottom frame member of the second structural frame;

the bracket is an angle bracket and includes a lower leg secured to the top frame member and an upper leg projecting upward from the lower leg and securable to the horizontally-adjacent vertical structure, and the two or more alignment pins project upward from the lower leg;

the bracket is secured to the first structural frame, the bracket and the two or more alignment pins are positioned and shaped so the two or more alignment pins engage the two or more apertures, the two or more alignment pins seat the bottom frame member over the top frame member, the bracket planarly aligns adjacent sides of the first structural frame and the second structural frame against the horizontally-adjacent vertical structure with the first modular infill panel unit securable to the horizontally-adjacent vertical structure through the bracket; and at least one of the bottom frame member or the top frame member is lengthwise mitered causing front faces of the first modular infill panel unit and the second modular infill panel unit to form an oblique angle.

15. A modular infill panel system for attachment to a horizontally-adjacent vertical structure, comprising:

a first modular infill panel unit including a first structural frame and a second modular infill panel unit including a second structural frame;

a first bracket assembly including a bracket and two or more alignment pins projecting upward from a top frame member of the first structural frame and aligned widthwise across the top frame member;

two or more apertures positioned widthwise across a bottom frame member of the second structural frame;

the bracket is secured to the first structural frame, the bracket and the two or more alignment pins are positioned and shaped so the two or more alignment pins engage the two or more apertures, the two or more alignment pins seat the bottom frame member over the top frame member, the bracket planarly aligns adjacent sides of the first structural frame and the second structural frame against the horizontally-adjacent vertical structure with the first modular infill panel unit securable to the horizontally-adjacent vertical structure through the bracket;

the bottom frame member includes a second two or more apertures positioned across widthwise across of the bottom frame member;

a second bracket assembly including a second bracket and a second two or more alignment pins projecting upward from the second bracket and aligned widthwise across the top frame member; and the second bracket is secured to the top frame member and is positioned and shaped so the second two or more alignment pins engage the second two or more apertures, seats the bottom frame member over the top frame member, planarly aligns second adjacent sides of the first structural frame and the second structural frame against a second horizontally-adjacent vertical structure.

16. The modular infill panel system of claim 15, wherein:

the second bracket is a second angle bracket; and the first modular infill panel unit securable to the second horizontally-adjacent vertical structure through the second angle bracket.

17. The modular infill panel system of claim 16, wherein:

the bottom frame member and the top frame member are widthwise-oblique angle with respect to each other causing front faces of the first modular infill panel unit and the second modular infill panel unit to form an oblique angle.

18. The modular infill panel system of claim 15, wherein:

the bottom frame member and the top frame member are widthwise-oblique angle with respect to each other causing front faces of the first modular infill panel unit and the second modular infill panel unit to form an oblique angle.

* * * * *